US008235089B2

(12) United States Patent
Kamasaka

(10) Patent No.: US 8,235,089 B2
(45) Date of Patent: Aug. 7, 2012

(54) METHOD FOR CASTING DISK ROTOR

(75) Inventor: Takeshi Kamasaka, Toyota (JP)

(73) Assignee: Aisin Takaoka Co., Ltd., Toyota-shi (JP)

( * ) Notice: Subject to any disclaimer, the term of this patent is extended or adjusted under 35 U.S.C. 154(b) by 28 days.

(21) Appl. No.: 12/677,190

(22) PCT Filed: Jul. 14, 2008

(86) PCT No.: PCT/JP2008/062709

§ 371 (c)(1),
(2), (4) Date: Mar. 9, 2010

(87) PCT Pub. No.: WO2009/057357

PCT Pub. Date: May 7, 2009

(65) Prior Publication Data

US 2010/0319871 A1 Dec. 23, 2010

(30) Foreign Application Priority Data

Oct. 29, 2007 (JP) ..... 2007-280142

(51) Int. Cl.
*B22D 17/04* (2006.01)

(52) U.S. Cl. ..... 164/133; 164/137; 164/339

(58) Field of Classification Search ..... 164/133, 164/137, 339

See application file for complete search history.

(56) References Cited

U.S. PATENT DOCUMENTS

| | | | | |
|---|---|---|---|---|
| 303,773 | A * | 8/1884 | Wiesing | 164/358 |
| 4,438,804 | A * | 3/1984 | Aiga et al. | 164/522 |
| 4,508,155 | A * | 4/1985 | Rousseau | 164/35 |

FOREIGN PATENT DOCUMENTS

| | | | |
|---|---|---|---|
| JP | 2004257422 | A * | 9/2004 |
| JP | 2004 344944 | | 12/2004 |
| JP | 2007 125572 | | 5/2007 |
| JP | 2007-209996 | | 8/2007 |
| JP | 2007 211828 | | 8/2007 |

OTHER PUBLICATIONS

Computer english translation of JP 2004257422 A.*

* cited by examiner

*Primary Examiner* — Jessica L Ward
*Assistant Examiner* — Erin Saad
(74) *Attorney, Agent, or Firm* — Oblon, Spivak, McClelland, Maier & Neustadt, L.L.P.

(57) ABSTRACT

The method casts a disk rotor which can restrain partial abrasion in a sliding ring part, particularly, in the circumferential outer surface. A mold includes a casting cavity to cast the sliding ring part, an outer circumference forming surface, an inner circumference forming surface, a gate group including a plurality of gates formed in the outer circumference forming surface at positions spaced apart from each other at predetermined intervals with respect to a circumferential direction, each of the gates having a central line P2 inclined at an angle greater than 0° and less than 90° with respect to a normal line passing through a center of the casting cavity in a radial direction, and runners. A melt is injected from the gates into the casting cavity at angles θ1, θ2 and θ3 which are greater than 0° and less than 90° with respect to the normal lines, and is solidified.

12 Claims, 13 Drawing Sheets

METHOD FOR CASTING DISK ROTOR

TECHNICAL FIELD

The present invention relates to a method for casting a disk rotor which is used in a brake system.

BACKGROUND ART

A disk rotor is made of cast iron containing graphite and includes a sliding ring part which has a circumferential outer surface and a circumferential inner surface. A sliding surface is formed between the circumferential outer surface and the circumferential inner surface of the sliding ring part. Graphite functions as a solid lubricant or to damp vibration, so that it can be effectively used to enhance the performance of the disk rotor. In the disk rotor, because the sliding surface of the sliding ring part comes into frictional contact with a relative member when braking, it is necessary to reduce partial abrasion with respect to the circumferential direction.

A representative method for casting a disk rotor using cast iron was proposed. (Patent Literature No. 1.) As shown in FIG. 16, a mold 5X used in this conventional method has a casting cavity 53X which forms a sliding ring part and has an annular shape, an outer circumference forming surface 531X which forms the circumferential outer surface of the sliding ring part and has an annular shape, and an inner circumference forming surface 532X which forms the circumferential inner surface of the sliding ring part and has an annular shape. Furthermore, gates 61X, 62X and 63X are formed in the outer circumference forming surface 531X of the mold 5X at positions spaced apart from each other at regular intervals with respect to the circumferential direction. In addition, runners 71X, 72X and 73X respectively communicate with the gates 61X, 62X and 63X. Here, the gates 61X, 62X and 63X are respectively oriented in the directions parallel to normal lines 77X, 78X and 79X passing through a central axis P5 of the casting cavity 53X in the radial directions.

Patent Literature No. 1: Japanese Unexamined Patent Publication (KOKAI) Gazette No. 2007-211828

DISCLOSURE OF THE INVENTION

Assignment to be Solved by the Invention

As such, in the conventional art, the gates 61X, 62X and 63X are formed at positions spaced apart from each other at regular intervals with respect to the circumferential direction of the casting cavity 53X, so that melt is injected from the gates 61X, 62X and 63X into the casting cavity 53X. Therefore, compared to the case where a single gate is formed in a mold, a temperature variation of melt with respect to the circumferential direction is reduced. Thus, the quality of the disk rotor can be uniformalized.

However, in the field of industry related thereto, in order to further improve the performance of vehicles, it is required to further reduce partial abrasion of the disk rotor and further increase the reliability thereof. Furthermore, in the disk rotor which is a sliding rotary body, a turning radius of the outer circumference side thereof is relatively large, so that sliding conditions thereof are strict, compared to that of the inner circumference side of the disk rotor. Hence, it has been required to further reduce partial abrasion with respect to the circumferential direction of the outer circumference side of the disk rotor.

Accordingly, the present invention has been made keeping in mind the above problems occurring in the prior art, and an object of the present invention is to provide a method for casting a disk rotor which can restrain partial abrasion in a sliding ring part, particularly, in the circumferential outer surface of the sliding ring part.

Means for Solving the Assignment (1) While the inventor of the present invention has been wholeheartedly developing the method for casting a disk rotor, the inventor discovered the following facts: (i) In the mold which has the outer circumference forming surface and the inner circumference forming surface which define a casting cavity, when melt is injected into the casting cavity from gates formed in the circumferential outer surface of the casting cavity, a degree to which the melt directly collides with the inner circumference forming surface of the mold in the radial direction is relatively high, so that it is easy to occur the biased flow of the melt in the circumferential direction of the casting cavity. (ii) Due to the above fact, with respect to the circumferential direction of the casting cavity, solidification speed of the portion of the melt which is present at positions facing the gates is very different from that of the portion of the melt which is present at positions between the gates. (iii) A variation in speed of the creation of graphite is caused by the difference of the solidification speed. Thus, a variation in size of the graphite with respect to the circumferential direction of the sliding ring part is increased. It is deduced that the abrasion of the sliding ring part starts to occur at a boundary between graphite and a matrix that is, where the graphite is dispersed. Hence, an increased variation in the size of graphite is undesirable in terms of restricting partial abrasion.

From the above facts, the inventor has discovered: that when an imaginary line passing through the center of the annular casting cavity for casting the disk rotor in the radial direction is designated as a normal line, if the central lines of the gates—which are formed in the outer circumference forming surface of the casting cavity at positions spaced apart from each other at regular intervals with respect to the circumferential direction—are inclined at angles greater than 0° and less than 90° with respect to the normal lines; thus, the object of the present invention can be achieved. The inventor discerned this through tests and completed the present invention.

(2) That is, a method for casting a disk rotor in accordance with the present invention is (i) a method for casting a disk rotor made of cast iron including graphite, the disk rotor including a sliding ring part having a circumferential outer surface and a circumferential inner surface, with a sliding surface formed between the circumferential outer surface and the circumferential inner surface of the sliding ring part, the method comprises: (ii) preparing a mold, comprising a casting cavity to cast the sliding ring part, the casting cavity having an annular shape; an outer circumference forming surface to form the circumferential outer surface of the sliding ring part; an inner circumference forming surface to form the circumferential inner surface of the sliding ring part; a gate group including a plurality of gates formed in the outer circumference forming surface at positions spaced apart from each other at predetermined intervals with respect to a circumferential direction, each of the gates having a central line inclined at an angle greater than 0° and less than 90° with respect to a normal line passing through a center of the casting cavity in a radial direction; runners respectively communicating with the gates constituting the gate group; and a sprue communicating with the runners; and (iii) pouring melt into the sprue of the mold, and supplying the melt to the gates of the gate group through the runners, and injecting the melt from the gates into the casting cavity at angles greater than 0° and less than 90° with respect to the normal lines, and solidifying the melt.

(3) In processes of injecting melt and solidifying it, the melt poured into a sprue of the mold is supplied to the gates through corresponding runners and is thereafter injected from the gates into the casting cavity at angles greater than 0° and less than 90° with respect to the normal lines. Then, the melt injected into the casting cavity from the gates is prevented from directly colliding with the inner circumference forming surface of the mold. Thereby, the conventional problem of branching currents induced by the direct collision of melt with the inner circumference forming surface of the mold can be prevented. As a result, in melt around the outer circumference forming surface in the casting cavity, a portion in which the temperature of the melt is excessively low and a portion in which the temperature of the melt is excessively high are restrained from being present together.

In other words, a temperature variation of melt with respect to the circumferential direction around the outer circumference forming surface of the casting cavity is reduced. As a result, this reduces a difference between the temperature of melt which is present between the gates and the temperature of melt which is present at positions facing the gates. Furthermore, a variation of solidification speed of melt with respect to the circumferential direction of the casting cavity is restrained, so that a variation in speed of the creation of graphite is also restrained. Hence, a variation in size of graphite can be reduced.

Effect of the Invention

According to the present invention, with respect to the circumferential direction of the annular casting cavity for forming the disk rotor, a temperature variation of melt in the casting cavity can be restrained, and a variation of solidification speed of the melt can be restrained, so that a variation in the size of graphite can be reduced. Therefore, with respect to the circumferential direction of the disk rotor, a variation of sliding characteristics of the disk rotor and partial abrasion can be restrained.

Particularly, a temperature variation of melt with respect to the circumferential direction of the circumferential outer surface of the disk rotor can be restrained, and a variation of solidification speed of the melt and a variation in the size of graphite can be restrained. As a result, with respect to the circumferential direction of the disk rotor, a variation of sliding characteristics of the disk rotor and partial abrasion can be reduced. Therefore, the reliability of the disk rotor can be further enhanced.

BRIEF DESCRIPTION OF THE DRAWINGS

The above and other objects and features of the present invention will become apparent from the following description of specified embodiments, given in conjunction with the accompanying drawings, in which.

EXPLANATION ON REFERENCE NUMERALS

Figure 1:
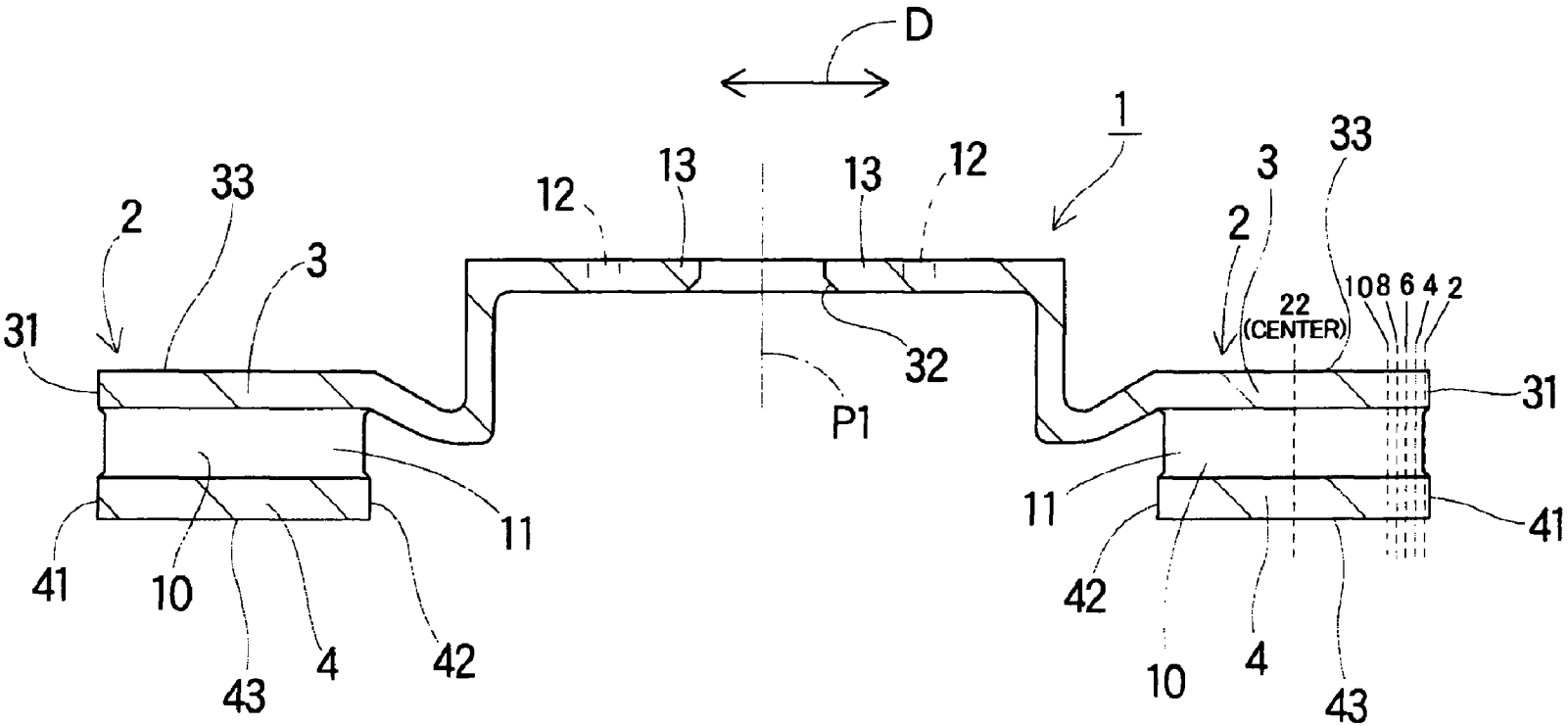
FIG. 1 is a sectional view illustrating a disk rotor according to the present invention.

1 denotes a disk rotor, 2 denotes a sliding ring part, 3 denotes an outer ring part, 31 denotes a first circumferential outer surface of an outer ring part, 32 denotes a first circumferential inner surface of the outer ring part, 4 denotes an inner ring part, 41 denotes a second circumferential outer surface of an inner ring part, 42 denotes a second circumferential inner surface of the inner ring part, 5 denotes a mold, 51 denotes a first mold (a main body of the mold), 52 denotes a core mold, 53 denotes a first casting cavity, 54 denotes a second casting cavity, 531 denotes a first outer circumference forming surface, 532 denotes a first inner circumference forming surface, 541 denotes a second outer circumference forming surface, 542 denotes a second inner circumference forming surface, 6 denotes a gate group, 61 denotes a first gate, 62 denotes a second gate, 63 denotes a third gate.

BEST MODE FOR CARRYING OUT THE INVENTION

Various embodiments of the present invention will now be described in detail with reference to the accompanying drawings. Gates constituting a gate group are formed in an outer circumference forming surface of a casting cavity at positions spaced apart from each other at regular intervals with respect to the circumferential direction. The number of gates may be two or more. However, if excessively many gates are present, material yield is reduced. Therefore, it is preferable that the number of gates be two through eight, particularly, two through six or two through four, although it may be dependent on the size of a disk rotor. Furthermore, as the outer diameter of the disk rotor is increased, the number of gates is typically increased.

Each gate has a central line which makes an angle θ greater than 0° and less than 90° with respect to a normal line passing through the center of the casting cavity in the radial direction. The angle θ typically ranges from 10° to 85° or from 10° to 80°. Preferably, the angle θ ranges from 20° to 70°. More preferably, the angle θ ranges from 30° to 60°. As the angle θ approaches 90°, the central line of the gate becomes parallel to the tangential direction of the outer circumference forming surface of the casting cavity. In this case, melt can smoothly flow in the casting cavity in the circumferential direction. On the other hand, as the angle θ approaches 0°, an angle between the central line of the gate and the tangential direction of the outer circumference forming surface of the casting cavity is increased. In this case, the possibility of direct collision of melt with the inner circumference forming surface of the mold is increased. Here, the melt is preferably flake graphite cast iron, but it may be upthrust graphite cast iron or spheroidal graphite cast iron.

When melt is injected into the casting cavity from the gates of the gate group, it is preferable that the direction in which melt is injected from each gate into the casting cavity be the same as the circumferential direction of the casting cavity. In other words, the central lines of the gates of the gate group are preferably inclined at angles corresponding to the circumferential direction around the central axis of the casting cavity.

Preferably, (i) when of the members of a gate group, a gate which is farthest from a sprue (that is, a flow distance of melt from the sprue is the longest) is called a distal gate, and an inertial direction of melt flowing to the distal gate through a corresponding runner is designated as a normal flow direction of the distal gate, (ii) the distal gate may be inclined in the direction in which melt injected into the casting cavity from the distal gate flows along the normal flow direction. (iii) Remaining gates may be inclined in the direction in which melt flows along the direction in which melt is injected into the casting cavity from the distal gate. In the case of the distal gate, the melt flow distance from the sprue is the longest compared to the remaining gates. Therefore, the temperature and thermal energy of melt which reaches the distal gate may be lower than those of melt which reaches the remaining gates. In this case, if melt which passes through the distal gate flows in the normal flow direction (that is, in the inertial direction of melt flowing to the distal gate through the corresponding runner) of the distal gate, the flowability of the melt having low temperature and thermal energy can be reliably increased. Furthermore, the melt which has low thermal energy at a low temperature can be prevented from partially stagnating with respect to the circumferential direction of the casting cavity of the mold. In addition, with respect to the circumferential direction around the outer circumference forming surface of the casting cavity, a temperature variation of the melt can be reduced. As well, with respect to the circumferential direction, partial variation of the solidification speed can be restrained, so that variation in the size of graphite can be prevented.

Furthermore, preferably, (i) when of the members of the gate group, a gate which has the shortest melt flow distance (is nearest to the sprue) is called a proximal gate, and an inertial direction of melt flowing to the proximal gate through a corresponding runner is designated as a normal flow direction, and the direction opposite the normal flow direction of the proximal gate is designated as a reverse flow direction of the proximal gate, (ii) the proximal gate may be inclined in the direction in which melt injected into the casting cavity from the proximal gate flows along the reverse flow direction of the proximal gate. (iii) Remaining gates may be inclined in the direction in which melt flows along the direction in which melt is injected into the casting cavity from the proximal gate. In the case of the proximal gate, the melt flow distance from the sprue is the shortest compared to that of the remaining gates. Therefore, the temperature and thermal energy of melt which reaches the proximal gate may be higher than those of melt which reaches the remaining gates. In this case, if melt which passes through the proximal gate flows in the reverse flow direction of the proximal gate and not in the normal flow direction (that is, not in the inertial direction of melt flowing to the proximal gate through the corresponding runner) of the proximal gate, the flowability of the melt having high temperature and thermal energy can be prevented from being excessively increased. Furthermore, melt which is injected into the casting cavity from the remaining gates and has low thermal energy at a low temperature can be prevented from partially stagnating in the casting cavity of the mold. In addition, with respect to the circumferential direction around the outer circumference forming surface of the casting cavity, a temperature variation of the melt can be reduced. As well, with respect to the circumferential direction, partial variation of the solidification speed can be restrained, so that variation in the size of graphite can be prevented.

In addition, the distal gate of the gate group may be set such that an inclination angle thereof with respect to the normal line is the largest. If the inclination angle with respect to the normal line is the largest, it means that the orientation of the central line of the distal gate is most similar to that of a tangential line of the outer circumference forming surface of the casting cavity. The flow distance of melt flowing from the sprue to the distal gate is longer than that of the remaining gates. Therefore, the temperature and thermal energy of melt which reaches the distal gate may be lower than those of melt which reaches the other gates. In consideration of this, melt is injected into the casting cavity through the distal gate in the direction similar to that of the tangential line of the outer circumference forming surface of the casting cavity. Then, the flowability of the melt is increased. Thereby, the melt having low thermal energy can be prevented from partially stagnating in the casting cavity. Therefore, with respect to the circumferential direction around the outer circumference forming surface of the casting cavity, a temperature variation of the melt can be reduced. As well, with respect to the circumferential direction, a partial variation of the solidification speed can be restrained, so that variation in the size of graphite can be prevented.

Furthermore, the proximal gate of the gate group may be set such that an inclination angle thereof with respect to the normal line is the largest. Because the proximal gate has the shortest melt flow distance from the sprue compared to that of the remaining gates, the temperature and thermal energy of melt which reaches the proximal gate may be higher than those of melt which reaches the remaining gates. In this case, if the melt having the high temperature and thermal energy is injected into the casting cavity in the direction similar to the tangential line of the outer circumference forming surface of the casting cavity, the flowability of melt is increased. Then, the melt which is around the outer circumference forming surface of the casting cavity can be maintained at high temperature. Thereby, a temperature variation of the melt with respect to the circumferential direction can be reduced. Furthermore, in the case where thermal energy of melt is high, solidification speed of the melt becomes smooth, compared to that of the case where thermal energy of the melt is relatively low. Thus, the growth of graphite can be promoted.

Preferably, the mold may comprise a mold body and a shell core mold which is supported by the mold body. At least portion of a gate space of the gate group may be partitioned by a shell forming surface of the shell core mold which is hardened by binder. In the case where an inclination angle of the central line of the gate is relatively large, the portion of the mold which defines the gate is typically acute in shape. In this case, the acute portion of the mold may be damaged by melt, resulting in defective casting. To prevent this, if at least portion of the gate space is partitioned by the shell forming surface of the shell core mold, the mold is prevented from being damaged, thus preventing defective casting. Because the shell core mold is formed by hardening a combination of sands with thermosetting plastic, a probability of damage or collapse caused by melt is reduced.

Preferably, with regard to the thickness of the sliding ring part, the circumferential outer surface of the sliding ring part may be thicker than the circumferential inner surface of the sliding ring part. In this case, the thermal energy of melt is increased around the outer circumference forming surface of the casting cavity. Therefore, the temperature of melt is prevented from partially decreasing around the outer circumference forming surface of the casting cavity. Thus, a partial variation of solidification speed of melt can be reduced, so that a variation in the size of graphite can be reduced.

Furthermore, according to the material, the mold may be classified into a green sand mold, a shell mold, a ceramic mold, a concrete mold, a metal mold, etc. Composition of cast iron for forming the disk rotor is not specially limited, so long as it can create graphite, such as flake graphite, upthrust graphite, etc. Although the composition of cast iron may be changed depending on the material of the mold, for example, if the entire weight of the cast iron is 100%, the cast iron may have a mass ratio of C: 2.0~4.2%, Si: 0.8~6.5%, Mn: 0.05~2.0%, P: 0.5% or less, S: 0.5% or less, the remnant including Fe and unavoidable impurities. However, the composition of the cast iron is not limited to this. As necessary, the cast iron may contain elements of other alloys.

Moreover, preferably, each gate may be defined by two facing sidewalls facing each other. At least one (preferably, both) extension line extending from the two facing sidewalls may be prevented from being in contact with the inner circumference forming surface of the mold. In this case, melt injected into the casting cavity from the gates is prevented from directly colliding with the inner circumference forming surface of the mold. Therefore, the melt can more smoothly flow in the circumferential direction of the casting cavity. Thereby, the temperature of the melt is prevented from partially decreasing around the outer circumference forming surface of the casting cavity. As a result, a variation of solidification speed of melt is reduced, and a variation in speed of the creation of graphite is reduced, so that a variation in the size of graphite can be reduced.

First Embodiment

Hereinafter, a first embodiment of the present invention will be described with reference to FIGS. 1 through 4.

This embodiment illustrates a method for manufacturing a disk rotor 1 for vehicles. As shown in FIG. 1, the disk rotor 1 includes a sliding ring part 2 which is provided around a central axis P1. The sliding ring part 2 includes an outer ring part 3, and an inner ring part 4 which faces the outer ring part 3. A blade part 11 is provided between the outer ring part 3 and the inner ring part 4. The blade part 11 defines a cooling passage 10 through which air passes. Therefore, the disk rotor 1 can be designated as a ventilated type rotor which ensures satisfactory cooling ability.

The outer ring part 3 has a mounting part 13 which extends inwards based on the inner ring part 4 with respect to the radial direction (the direction of the arrow D). The mounting part 13 has mounting holes 12 therein. The mounting holes 12 may be formed through a casting process or, alternatively, it may be formed through a post process. The outer ring part 3 has a first circumferential outer surface 31 which forms the outer edge of the outer ring part 3, and a first circumferential inner surface 32 which forms the inner edge of the mounting part 13. A first sliding surface 33 which has a planar ring shape is formed between the first circumferential outer surface 31 and the first circumferential inner surface 32. The inner ring part 4 has a second circumferential outer surface 41 which forms the outer edge of the inner ring part 4, and a second circumferential inner surface 42 which forms the inner edge of the inner ring part 4. A second sliding surface 43 which has a planar ring shape is formed between the second circumferential outer surface 41 and the second circumferential inner surface 42.

When braking, the first sliding surface 33 comes into frictional contact with a relative member which is disposed at a first position. Simultaneously, the second sliding surface 43 comes into frictional contact with a relative member which is disposed at a second position. The sliding ring part 2 is made of flake graphite cast iron which is formed by dispersing flake graphite in a matrix. One selected from a pearlitic matrix, a ferritic matrix, a pearlitic-ferritic matrix, an austenitic matrix and a bainitic matrix is used as the matrix.

Figure 2:
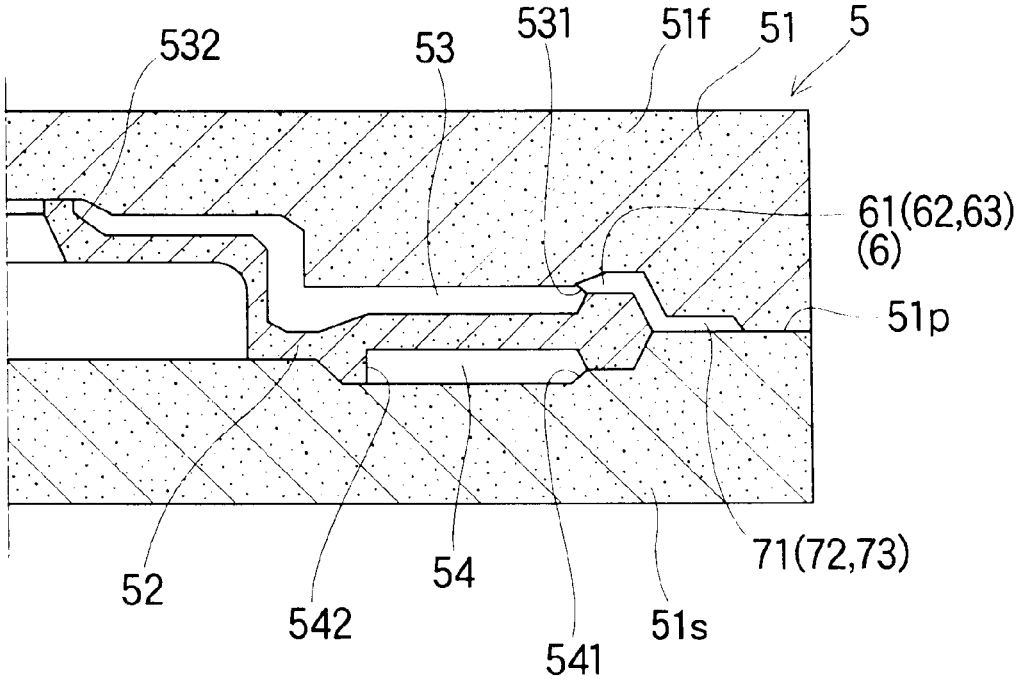
FIG. 2 is a vertical sectional view of a half of a mold having a first casting cavity and a second casting cavity for casting the disk rotor of FIG. 1.

FIG. 2 is a vertical sectional view of a half of a mold 5 for casting the disk rotor 1. As shown in FIG. 2, the mold 5 is a green sand mold and includes a first mold 51 which functions as a main body of the mold, and a core mold (second mold) 52 which is embedded in the first mold 51. The first mold 51 includes a first partial mold 51*f* which is an upper mold, and a second partial mold 51*s* which is a lower mold. A separation surface 51*p* is defined between the first partial mold 51*f* and the second partial mold 51*s* in the horizontal direction. The mold 5 has a first casting cavity 53 which has an annular shape and forms the outer ring part 3, and a second casting cavity 54 which has an annular shape and forms the inner ring part 4. Furthermore, the mold 5 has a first outer circumference forming surface 531 which forms the first circumferential outer surface 31 of the outer ring part 3, and a second outer circumference forming surface 541 which forms the second circumferential outer surface 41 of the inner ring part 4. The mold 5 further has a first inner circumference forming surface 532 which has an annular shape and forms the first circumferential inner surface 32 of the outer ring part 3, and a second inner circumference forming surface 542 which has an annular shape and forms the second circumferential inner surface 42 of the inner ring part 4.

Figure 3:
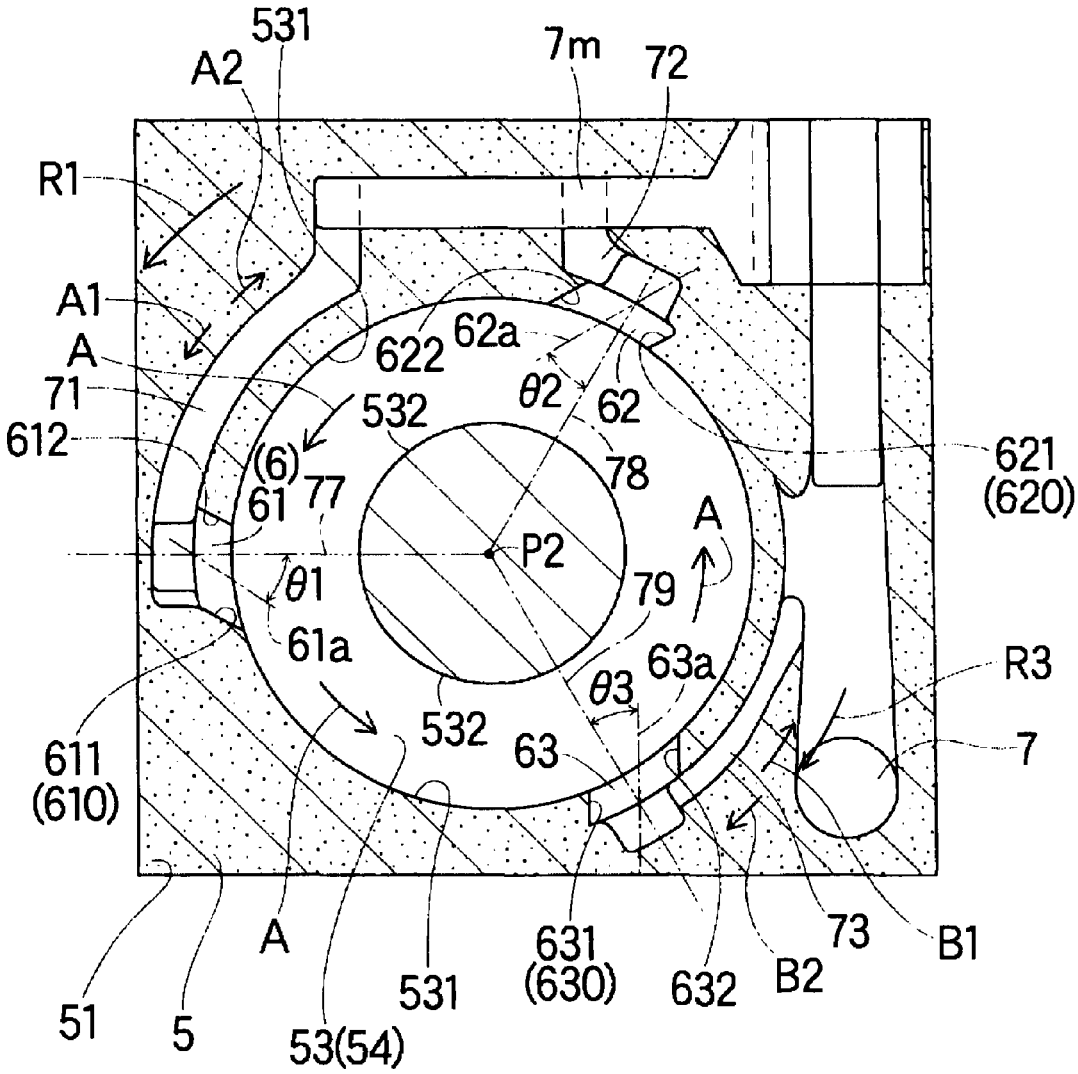
FIG. 3 is a horizontal sectional view showing the first casting cavity of the mold of FIG. 2 for casting the disk rotor.

FIG. 3 is a sectional view taken along the horizontal direction to show a portion of the mold 5. FIG. 3 shows only a portion of the mold 5. Actually, for mass production purposes, the four molds shown in FIG. 3 are integrally installed in a line. As shown in FIG. 3, the mold 5 includes a gate group 6 which comprises a first gate 61, a second gate 62 and a third gate 63. Furthermore, the mold 5 has a first runner which communicates with the first gate 61, a second runner 72 which communicates with the second gate 62, and a third runner 73 which communicates with the third gate 63. In addition, the mold 5 has a sprue 7 which communicates with the first runner 71, the second runner 72 and the third runner 73. Here, the first runner 71, the second runner 72 and the third runner 73 are formed in the mold 5 along the circumference of the first casting cavity 53 into arc shapes.

The first runner 71 and the second runner 72 have a common runner part which extends from the sprue 7 to a distribution part 7*m*, and they branch off from the distribution part 7*m*. Referring to FIG. 3, the first runner 71 extends in a counterclockwise direction (in the direction of the arrow R1) towards the first casting cavity 53 and the second casting cavity 54. The second runner 72 and the third runner 73 extend in a clockwise direction (in the direction of the arrow R3) towards the first casting cavity 53 and the second casting cavity 54. The directions of the arrows R1 and R3 are the reverse of each other with respect to the circumferential direction.

The first gate 61, the second gate 62 and the third gate 63 are formed in the first outer circumference forming surface 531 of the first casting cavity 53 at positions spaced apart from each other at regular intervals with respect to the circumferential direction. The first gate 61 has a first central line 61*a* which is inclined at an angle of θ1 (greater than 0° and less than 90°) with respect to a first normal line 77 that radially passes through a central axis P2 of the first casting cavity 53. Furthermore, the first gate 61 has first facing sidewalls 610 which face each other based on the first central line 61*a*. The first facing sidewalls 610 comprises a downstream facing sidewall 611 which is disposed at a downstream side of the first runner 71, and an upstream facing sidewall 612 which is disposed at a side which is upstream of the downstream facing sidewall 611. The downstream facing sidewall 611 and the upstream facing sidewall 612 face each other in a gate space of the first gate 61 and are almost parallel to the first central line 61*a*.

The second gate 62 has a second central line 62*a* which is inclined at an angle of θ2 (greater than 0° and less than 90°) with respect to a second normal line 78 that radially passes through the central axis P2 of the first casting cavity 53. Furthermore, the second gate 62 has second facing sidewalls 620 which face each other based on the second central line 62*a*. The second facing sidewalls 620 comprise a downstream facing sidewall 621 which is disposed at a downstream side of the second runner 72, and an upstream facing sidewall 622 which is disposed at a side which is upstream of the downstream facing sidewall 621. The downstream facing sidewall 621 and the upstream facing sidewall 622 face each other in a gate space of the second gate 62 and are almost parallel to the second central line 62*a*.

The third gate 63 has a third central line 63*a* which is inclined at an angle of θ3 (greater than 0° and less than 90°) with respect to a third normal line 79 that radially passes through the central axis P2 of the first casting cavity 53. Furthermore, the third gate 63 has third facing sidewalls 630 which face each other based on the third central line 63*a*. The third facing sidewalls 630 comprise a downstream facing sidewall 631 which is disposed at a downstream side of the third runner 73, and an upstream facing sidewall 632 which is disposed at an upstream side of the downstream facing sidewall 631. The downstream facing sidewall 631 and the upstream facing sidewall 632 face each other in a gate space of the third gate 63 and are almost parallel to the third central line 63*a*.

In this embodiment, the first central line 61*a* of the first gate 61, the second central line 62*a* of the second gate and the third central line 63*a* of the third gate 63 are inclined in the same direction with respect to the circumferential direction around the central axis P2 of the first casting cavity 53. That is, with regard to the flow of melt from the gates 61, 62 and 63 constituting the gate group 6 into the first casting cavity 53, the melt is preferably drawn into the first casting cavity 53 from the gates 61, 62 and 63 in the same direction with respect to the circumferential direction of the first casting cavity 53. This can be realized by the structure in which the central axes 61*a*, 62*a* and 63*a* of the gates 61, 62 and 63 of the gate group 6 are inclined in the same direction with respect to the circumferential direction around the central axis P2 of the first casting cavity 53.

Basically, θ1, θ2 and θ3 satisfy $0°<\theta1=\theta2=\theta3<90°$ or $0°<\theta1\approx\theta2\approx\theta3<90°$. Particularly, θ1, θ2 and θ3 may satisfy $20°<\theta1=\theta2=\theta3<80°$ or $20°<\theta1\approx\theta2\approx\theta3<80°$. In addition, θ1, θ2 and θ3 may satisfy $30°<\theta1=\theta2=\theta3<70°$ or $30°<\theta1\approx\theta2\approx\theta3<70°$.

If a flow cross-sectional area of the first gate 61 is denoted by S1, a flow cross-sectional area of the second gate 62 is denoted by S2, and a flow cross-sectional area of the third gate 63 is denoted by S3, the relation of S1=S2=S3 or S1≈S2≈S3 is satisfied. Here, S1/S3=S2/S3 can be satisfied. In addition, S1/S3 and S2/S3 range from 0.7 to 1.3 and, preferably, range from 0.8 to 1.2 or from 0.9 to 1.1. Preferably, flow cross-sectional areas of the first runner 71, the second runner 72 and the third runner 73 are set such that melt can be distributed from the first gate 61, the second gate 62 and the third gate 63 as evenly as possible. As necessary, the relationship between the sizes of S1, S2 and S3 may be adjusted.

The first gate 61 of the gate group 6 is called a distal gate as it is farthest from the sprue 7 (that is, a flow distance of melt from the sprue 7 is the longest). Here, an inertial direction of melt flowing to the distal gate (the first gate 61) through the first runner 71 is designated as a normal flow direction (the direction of the arrow A1 of FIG. 3) of the distal gate (the first gate 61). Furthermore, the direction opposite the normal flow direction of the distal gate (the first gate 61) is designated as a reverse flow direction (the direction of the arrow A2 of FIG. 3). In this embodiment, the first central line 61*a* of the first gate 61 (the distal gate) is inclined in the direction in which melt injected into the first casting cavity 53 from the distal gate (the first gate 61) flows along the normal flow direction (the direction of the arrow A1 or the arrow A) of the distal gate (the first gate 61).

The central axes of the remaining gates of the gate group 6, that is, the second central line 62*a* of the second gate 62 and the third central line 63*a* of the third gate 63, are inclined in the direction in which melt flows in the first casting cavity 53 along the direction of the arrow A (the inertial direction of melt flowing to the first gate 61 through the first runner 71), in other words, in the circumferential direction of the first casting cavity 53. Here, in the first casting cavity 53, melt flows in the direction of the arrow A (see, FIG. 3) which is almost the same as the normal flow direction (the direction of the arrow A1) of the distal gate (the first gate 61) with respect to the circumferential direction.

The flow distance of melt flowing from the sprue 7 to the first gate 61 which is the distal gate is longer than that of the second gate 62 and the third gate 63. Therefore, the temperature and thermal energy of melt which reaches the first gate 61 (the distal gate) may be lower than those of melt which reaches the other gate (the second gate 62 or the third gate 63). However, because melt which passes through the first gate 61 (the distal gate) flows in the normal flow direction (the direction of the arrow A1, that is, the inertial direction of melt flowing to the first gate 61 through the first runner 71) of the first gate 61 (the distal gate), the flowability of the melt having a low temperature and thermal energy can be reliably increased. Furthermore, the melt which has low thermal energy at a low temperature can be prevented from partially stagnating with respect to the circumferential direction of the first casting cavity 53 of the mold 5. In addition, with respect to the circumferential direction around the first outer circumference forming surface 531 of the first casting cavity 53, a temperature variation of the melt can be reduced. As well, with respect to the circumferential direction, partial variation of the solidification speed can be restrained, so that variation in the size of graphite can be prevented.

The third gate 63 of the gate group 6 is called a proximal gate as it is the shortest from the sprue 7 (that is, a flow distance of melt from the sprue 7 is the nearest). Here, an inertial direction of melt flowing to the third gate 63 (the proximal gate) through the third runner 73 is designated as a normal flow direction (the direction of the arrow B2) of the third gate 63 (the proximal gate). The direction opposite the normal flow direction of the third gate 63 (the proximal gate) is designated as a reverse flow direction (the direction of the arrow B1) of the third gate 63. In this embodiment, the third central line 63*a* of the third gate 63 (the proximal gate) is inclined in the direction in which melt injected into the first casting cavity 53 from the third gate 63 flows in the reverse flow direction (the direction of the arrow B1) opposite the normal flow direction of the third gate 63.

The central axes of the remaining gates of the gate group 6, that is, the first central line 61*a* of the first gate 61 and the second central line 62*a* of the second gate 62, are inclined in the direction in which melt flows from the third gate 63 (the proximal gate) into the first casting cavity 53, that is, in the normal flow direction of the melt (in the direction of the arrow B1).

Here, the flow distance of melt flowing from the sprue 7 to the third gate 63 (the proximal gate) is shorter than that of the first gate 61 and the second gate 62. Therefore, the temperature and thermal energy of melt which reaches the third gate 63 (the proximal gate) may be higher than those of melt which reaches the first gate 61 or the second gate 62. However, because melt which passes through the third gate 63 (the proximal gate) flows in the first casting cavity 53 in the reverse flow direction (the direction of the arrow B1 of FIG. 3) of the third gate 63 (the proximal gate) but not in the normal flow direction (the direction of the arrow B2 of FIG. 2) of the third gate 63, the flowability of melt having a high temperature and thermal energy can be prevented from being excessively increased compared to melt which is injected into the first casting cavity 53 through the gates 61 and 62.

Furthermore, the melt which is injected into the first casting cavity 53 through the first gate 61 and the second gate 62 and has relatively low thermal energy at a low temperature can be prevented from partially stagnating with respect to the circumferential direction of the first casting cavity 53. In addition, with respect to the circumferential direction of the first casting cavity 53, a temperature variation of the melt can be reduced. As well, partial variation of the solidification speed can be restrained, so that variation in the size of graphite can be prevented.

Particularly, in the first embodiment, melt which is injected into the first casting cavity 53 through the gates 61, 62 and 63 can smoothly flow in the first casting cavity 53 along the first outer circumference forming surface 531 of the mold 5 in the circumferential direction (in the direction of the arrow A of FIG. 3). Accordingly, in the first embodiment, with respect to the circumferential direction around the first outer circumference forming surface 531, a temperature variation of the melt can be reduced, and partial variation of the solidification speed can be restrained, so that variation in the size of graphite can be prevented.

Moreover, in the first embodiment, the second casting cavity 54 communicates with and is coaxial with the first casting cavity 53. Thus, the above-mentioned contents pertaining to the first casting cavity 53 can be also identically applied to the second casting cavity 54. In other words, with respect to the circumferential direction around the second outer circumference forming surface 541 of the second casting cavity 54, a temperature variation of the melt can be reduced, and partial variation of the solidification speed can be restrained, so that variation in the size of graphite can be prevented.

As can be understood from the above description, melt which is poured through the sprue 7 into the mold 5 is drawn from the first gate 61, the second gate 62 and the third gate 63 into the first casting cavity 53 via the first runner 71, the second runner 72 and the third runner 73 at angles θ1, θ2 and θ3 which are greater than 0° and less than 90° with respect to the normal lines 61*a*, 62*a* and 63*a*.

Thanks to this structure, the melt which is injected into the first casting cavity 53 from the first gate 61, the second gate 62 and the third gate 63 can be prevented from directly colliding with the first inner circumference forming surface 532 of the first mold 51 in the radial direction. As a result, the present invention can solve the problem of the conventional art in which branching currents of melt occur attributable to direct collision. Furthermore, the present invention solves the problem in which a partial low temperature area where the temperature of melt is partially low and a partial high temperature area where the temperature of melt is partially high are formed around the first outer circumference forming surface 531 of the first casting cavity 53. With regard to the second casting cavity 54, the same effects are ensured.

Therefore, according to the first embodiment, a temperature variation of melt with respect to the circumferential direction around the first outer circumference forming surface 531 of the first casting cavity 53 can be reduced. In the same manner, a temperature variation of melt with respect to the circumferential direction around the second outer circumference forming surface 541 of the second casting cavity 54 can also be reduced. As a result, the present invention can reduce a variation between a temperature of melt which is solidified between the gates 61, 62 and 63 with respect to the circumferential direction of the casting cavities 53 and 54 and a temperature of melt which is solidified at positions facing the gates 61, 62 and 63. Furthermore, a variation of the solidification speed of melt with respect to the circumferential direction can be restrained.

As a result, in the disk rotor 1, a variation in the size of graphite with respect to the circumferential direction of the first circumferential outer surface 31 of the outer ring part 3 can be reduced. In addition, a variation of sliding characteristics of the disk rotor 1 with respect to the circumferential direction can be restrained. Thus, a variation in the size of graphite with respect to the circumferential direction of the first circumferential outer surface 31 of the outer ring part 3 can be reduced, and partial abrasion of the first sliding surface 33 and the second sliding surface 43 with respect to the circumferential direction can be prevented.

In the same manner, with respect to the circumferential direction of the second circumferential outer surface 41 of the inner ring part 4, a variation in the size of graphite can be reduced. In addition, a variation of sliding characteristics with respect to the circumferential direction can be restrained. Therefore, the reliability of the disk rotor 1 can be further enhanced.

Figure 4A:
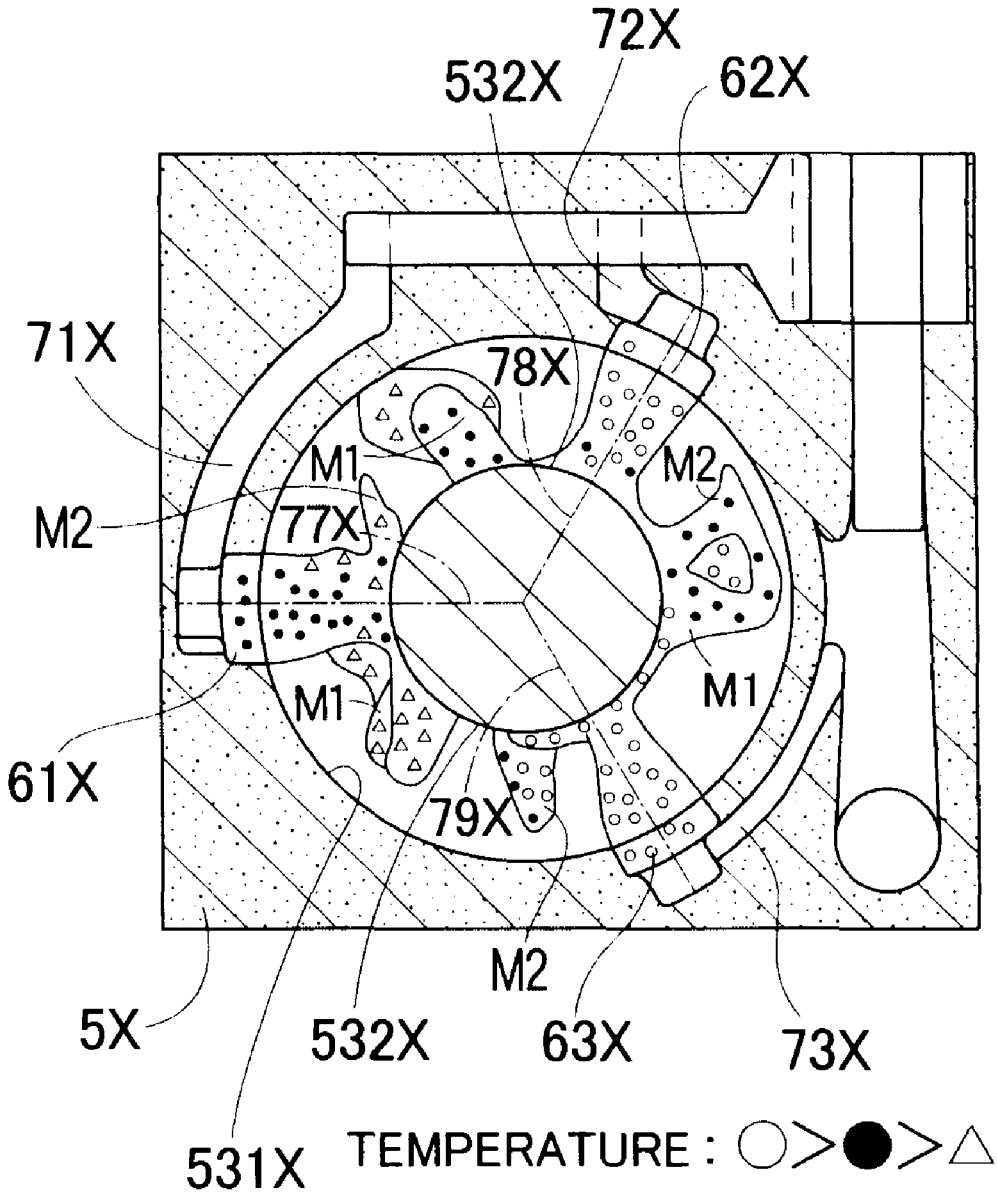
FIG. 4A is a horizontal sectional view showing a first casting cavity of a mold for casting a disk rotor, according to the conventional art.
Figure 4B:
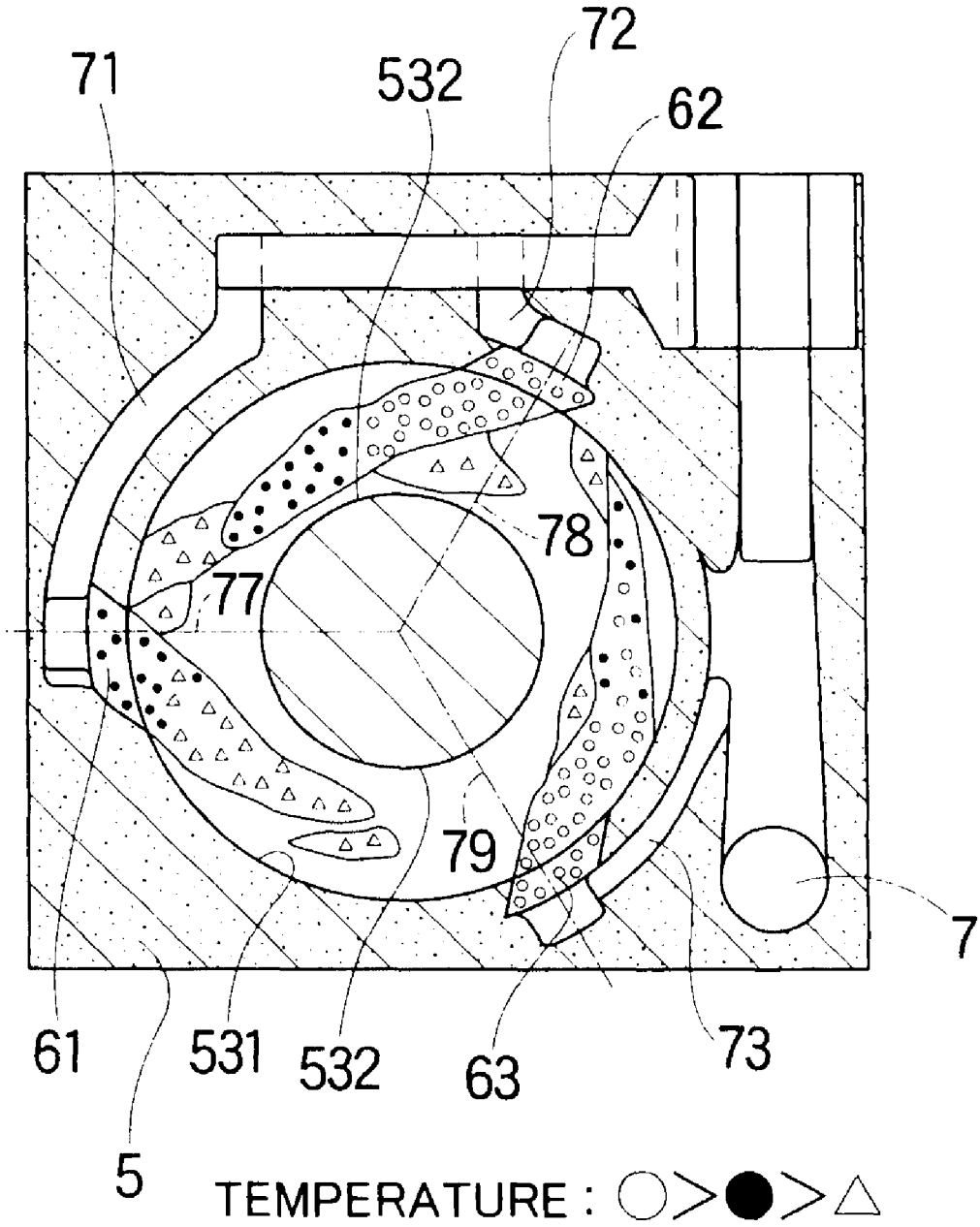
FIG. 4B is a horizontal sectional view showing a first casting cavity of a mold for casting a disk rotor, according to a first embodiment of the present invention.

FIGS. 4A and 4B illustrate the results of tests of solidification of melt in the first casting cavity 53 which are analyzed by melt solidifying simulation software (QUALICA, JSCAST). FIG. 4A illustrates the results of the analysis according to the conventional art. FIG. 4B illustrates the results of the analysis according to the first embodiment.

Here, the temperature of melt is expressed by marks ○, ● and Δ, and they satisfy the relation of ○>●>Δ. In the conventional art shown in FIG. 4A, it is set as θ1=θ2=θ3=0°. In the structure according to the conventional art, melt which is injected into the first casting cavity 53 from the first gate 61X, the second gate 62X and the third gate 63X mainly directly collides with the first inner circumference forming surface 532X of the mold 5X in the radial direction. Hence, the melt is divided into both sides on the collision portion, thus forming branching currents M1 and M2. The branching currents M1 and M2 of the melt move towards the first outer circumference forming surface 531X of the mold 5X in almost the radial direction. Therefore, in the conventional structure, with regard to the first circumferential outer surface 31 of the outer ring part 3 of the disk rotor 1, a partial temperature variation of melt with respect to the circumferential direction is induced. Furthermore, a variation of the solidification speed of melt is caused. Thereby, a difference (variation) in the size of graphite with respect to the circumferential direction in the first circumferential outer surface 31 of the outer ring part 3 is increased.

On the other hand, in the first embodiment illustrated in FIG. 4B, melt which is injected into the first casting cavity 53 from the first gate 61, the second gate 62 and the third gate 63 flows in the direction similar to that of a tangential line of a corresponding portion of the first outer circumference forming surface 531. Therefore, the melt is prevented from directly colliding with the first inner circumference forming surface 532 of the mold 5, thus preventing it from being divided into both sides to form branching currents. In other words, in the first embodiment, melt mainly flows in the first casting cavity 53 of the mold 5 along the first outer circumference forming surface 531 in the circumferential direction. As a result, with the respect to the circumferential direction of the first circumferential outer surface 31 of the outer ring part 3 of the disk rotor 1 formed by solidifying the melt, a temperature variation of the melt and a variation of solidification speed thereof are reduced, so that a variation (difference) in the size of graphite is reduced. In the same manner, with respect to the circumferential direction of the second circumferential outer surface 41 of the inner ring part 4 of the disk rotor 1, a variation (difference) in the size of graphite is also reduced.

Second Embodiment

The general construction and operation of the second embodiment remain the same as those of the first embodiment and are thus referred to using FIGS. 1 through 3. Hereinafter, the second embodiment will be explained in detail, focusing on the differences between it and the first embodiment. In the same manner as the first embodiment, central axes 61*a*, 62*a* and 63*a* of gates 61, 62 and 63 constituting a gate group 6 are inclined in the same direction with respect to the circumferential direction of a central axis P2 of a first casting cavity 53. However, in the second embodiment, θ1, θ2 and θ3 satisfy 90°>θ1>θ2>θ3>0°. That is, the inclination angle θ1 of the first gate 61 (the distal gate) is greater than θ2 and θ3. The fact that the inclination angle θ1 is largest means that the orientation of the first central line 61*a* of the first gate 61 is most similar to that of a tangential line of a first outer circumference forming surface 531 of the first casting cavity 53.

The flow distance of melt flowing from the sprue 7 to the first gate 61 (the distal gate) is longer than that of the second gate 62 and the third gate 63. Therefore, the temperature and thermal energy of melt which reaches the first gate 61 (the distal gate) may be lower than those of melt which reaches the other gate (the second gate 62 or the third gate 63). In consideration of this, this embodiment is constructed such that melt is injected into the first casting cavity 53 through the first gate 61 in the direction similar to that of the tangential line of the first outer circumference forming surface 531 of the first casting cavity 53. Then, the flowability of the melt is increased.

Thereby, the melt having low thermal energy can be prevented from partially stagnating in the first casting cavity 53. Therefore, with respect to the circumferential direction around the first outer circumference forming surface 531 of the first casting cavity 53, a temperature variation of the melt can be reduced. As well, with respect to the circumferential direction around the second outer circumference forming surface 541 of the second casting cavity 54, a temperature variation of the melt can also be reduced. Furthermore, with respect to the circumferential direction, partial variation of the solidification speed can be restrained, so that variation in the size of graphite can be prevented. Preferably, in this embodiment, the maximum of θ1 may be one of 85°, 80°, 75°, 70° and 65°, and the minimum of θ3 may be one of 5°, 10°, 15°, 20°, 25° and 30°.

Third Embodiment

The general construction and operation of the third embodiment remain the same as those of the second embodiment and are thus referred to using FIGS. 1 through 3. Hereinafter, the third embodiment will be explained in detail, focusing on the differences between it and the second embodiment. In the same manner as the first embodiment, central axes 61*a*, 62*a* and 63*a* of gates 61, 62 and 63 constituting a gate group 6 are inclined in the same direction with respect to the circumferential direction of a central axis P2 of a first casting cavity 53. However, in the third embodiment, θ1, θ2 and θ3 satisfy 90°>θ1>θ2≈θ3>0°. In the third embodiment, the maximum of θ1 may be one of 85°, 80°, 75°, 70° and 65°, and the minimum of θ3 may be one of 5°, 10°, 15°, 20°, 25° and 30°.

Fourth Embodiment

The general construction and operation of the fourth embodiment remain the same as those of the first embodiment and are thus referred to using FIGS. 1 through 3. Hereinafter, the fourth embodiment will be explained in detail, focusing on the differences between it and the first embodiment. Of a gate group 6, an inclination angle θ3 of a third gate 63 (a proximal gate) is greater than θ1 and θ2 (θ3>θ1≈θ2). Here, in the case of the third gate 63 (the proximal gate), the melt flow distance that melt flows from a sprue 7 to the gate is shortest, compared to that of the other gates, that is, a first gate 61 and a second gate 62. Therefore, the temperature and thermal energy of melt which reaches the third gate 63 (the proximal gate) may be higher than those of melt which reaches the first gate 61 or the second gate 62. In this case, if the melt having the high temperature and thermal energy is injected into the first casting cavity 53 in a direction similar to a tangential line of the first outer circumference forming surface 531 of the first casting cavity 53, the flowability of melt is inherently increased. Then, the melt which is around the first outer circumference forming surface 531 of the first casting cavity 53 and the second outer circumference forming surface 541 of the second casting cavity 54 can be maintained at high temperature. Thereby, a temperature variation of the melt with respect to the circumferential direction can be reduced. Furthermore, in the case where thermal energy of melt injected into the first casting cavity 53 and the second casting cavity 54 is high, solidification speed of the melt becomes smooth, compared to that of the case where thermal energy of the melt is relatively low. Thus, the growth of graphite can be promoted.

Fifth Embodiment

The general construction and operation of the fifth embodiment remain the same as those of the first embodiment. Only, unlike the first embodiment, in the fifth embodiment, a first gate, a second gate, a third gate and a fourth gate (having an inclination angle of θ4 with respect to a normal line) are formed in the mold at positions spaced apart from each other. Basically, θ1, θ2, θ3 and θ4 satisfy 90°>θ1=θ2=θ3=θ4>0° or 90°>θ1≈θ2≈θ3≈θ4>0°.

Sixth Embodiment

Figure 5:
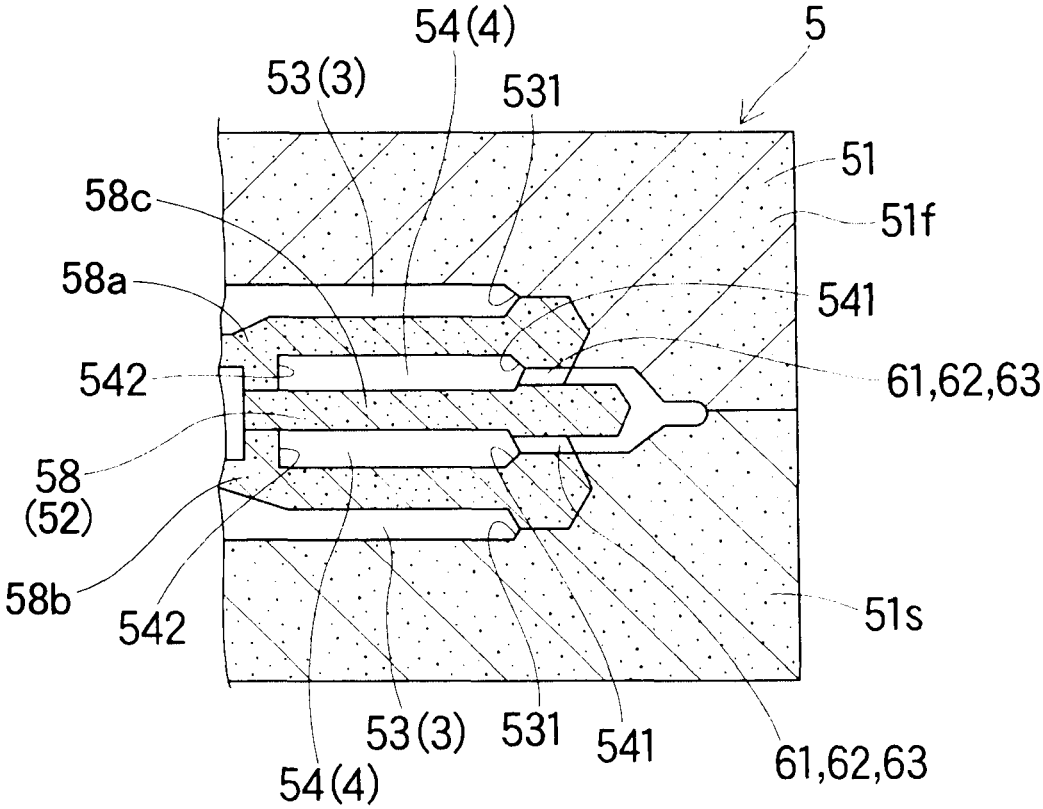
FIG. 5 is a vertical sectional view of a mold having a first casting cavity and a second casting cavity for casting a disk rotor, according to a sixth embodiment of the present invention.

FIG. 5 illustrates the sixth embodiment of the present invention. The sixth embodiment has the same construction and operation as those of the first embodiment. Hereinafter, the sixth embodiment will be explained in detail, focusing on the differences between it and the first embodiment. As shown in FIG. 5, a mold 5 has first casting cavities 53 which form an outer ring part 3 and have annular shapes, and second casting cavities 54 which form an inner ring part 4 and have annular shapes. Furthermore, the mold 5 includes first outer circumference forming surfaces 531 which form a first circumferential outer surface 31 of the outer ring part 3, and second outer circumference forming surfaces 541 which form a second circumferential outer surface 41 of the inner ring part 4. In addition, the mold 5 further includes second inner circumference forming surfaces 542 which form a second circumferential inner surface 42 of the inner ring part 4.

The two second casting cavities 54 are formed at upper and lower positions adjacent to each other such that they face each other and are parallel to each other. Furthermore, the first casting cavities 53 are formed above and below the second casting cavities 54. A gate space of a first gate 61 is divided by a shell forming surface of a shell core mold 58. In the same manner, a gate space of a second gate 62 and a gate space of a third gate 63 are also divided by the shell forming surface of the shell core mold 58.

In detail, if inclination angles θ1, θ2 and θ3 are set to 0° in the same manner as that of the conventional art, a portion of the mold which defines a first gate 61, a portion of the mold which defines a second gate 62, and a portion of the mold which defines a third gate 63 can have high strength against melt, because the portions don't form acute angles. If the inclination angles θ1, θ2 and θ3 are greater than 0° and less than 90° (for example, θ1, θ2 and θ3 range from 20° to 70°), acute portions of the mold which define gates may be damaged by contact with melt during a process of solidifying the melt. Thus, in this embodiment, the gate space of the first gate 61, the gate space of the second gate 62 and the gate space of the third gate 63 are divided by the shell forming surface of the shell core mold 58, thus preventing damage attributable to contact with melt. The shell core mold 58 is formed by combining sand with thermo setting plastic which functions as a binder and by solidifying the combination thereof. Therefore, the forming surface of the shell core mold 58 can resist damage or collapse, compared to the first mold 51 which is a green sand mold. The shell core mold 58 includes core mold parts 58*a*, 58*b* and 58*c*.

Seventh Embodiment

Figure 6:
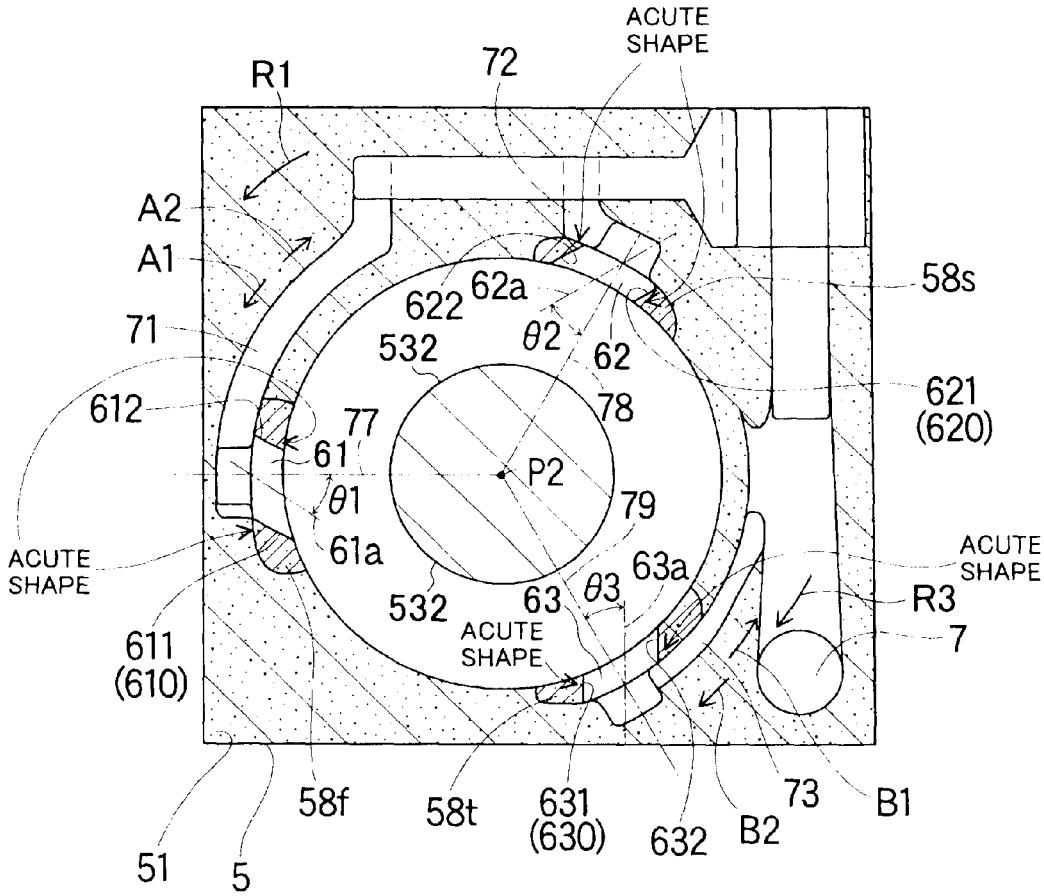
FIG. 6 is a horizontal sectional view showing a first casting cavity of a mold for casting a disk rotor, according to a seventh embodiment of the present invention.

FIG. 6 illustrates the seventh embodiment of the present invention. The seventh embodiment has the same construction and operation as those of the first embodiment. Hereinafter, the seventh embodiment will be explained in detail, focusing on the differences between it and the first embodiment. A mold 5 includes a first mold 51, and a first shell core mold 58*f*, a second shell core mold 58*s*, and a third shell core mold 58*t* which are supported by the first mold 51.

A forming surface of the first shell core mold 58*f* forms a gate space of a first gate 61. A forming surface of the second shell core mold 58*s* forms a gate space of a second gate 62. A forming surface of the third shell core mold 58*t* forms a gate space of a third gate 63. The first, second and third shell core molds 58*f*, 58*s* and 58*t* are formed by combining sand with thermo setting plastic which functions as a binder and by solidifying the combination thereof. Therefore, the forming surfaces of the shell core molds can reduce a probability of damage induced by contact with melt, compared to the forming surface of the first mold 51. Thus, even though θ1, θ2 and θ3 are relatively large, for example, such that they are almost 90° so that the portion defining the first gate 61, the portion defining the second gate 62 and the portion defining the third gate 63 have acute shapes, the strength of the portions can be ensured. Thereby, a speed at which melt is drawn into the gates can be increased. In this embodiment, as shown in FIG. 6, the first central line 61*a* of the first gate 61, the second central line 62*a* of the second gate 62 and the third central line 63*a* of the third gate 63 are also inclined in the same direction with respect to the circumferential direction around the central axis P2 of the first casting cavity 53.

Eighth Embodiment

Figure 7:
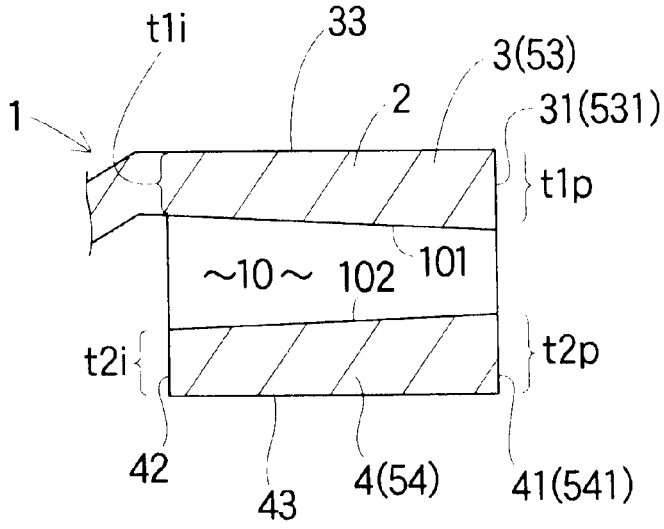
FIG. 7 is a sectional view showing portion of a circumference of a disk rotor, according to an eighth embodiment of the present invention.

FIG. 7 illustrates the eighth embodiment of the present invention. The general construction and operation of the eighth embodiment remain the same as those of the first embodiment and are thus referred to using FIGS. 1 through 3. Hereinafter, the eighth embodiment will be explained in detail, focusing on the differences between it and the first embodiment. With regard to a thickness of a sliding ring part 2, the thickness of the circumferential outer surface of the sliding ring part 2 is greater than that of the circumferential inner surface thereof. In other words, a thickness tip of a first circumferential outer surface 31 of an outer ring part 3 is greater than a thickness t1*i* of a first circumferential inner surface 32 of the outer ring part 3 (t1P>t1*i*). Furthermore, a thickness t2P of a second circumferential outer surface 41 of an inner ring part 4 is greater than a thickness t2*i* of a second circumferential inner surface 42 of the inner ring part 4 (t2P>t2*i*). A cooling passage 10 is defined by inner walls 101 and 102 which have inclined shapes such that it is reduced in width from the inner side to the outer side with respect to the radial direction. Therefore, excessive variation in thickness of the outer ring part 3 and the inner ring part 4 is prevented, so that the molding ability is superior, and creation of graphite becomes satisfactory. Here, a first sliding surface 33 and a second sliding surface 43 are parallel to each other.

In a first casting cavity 53 of this embodiment, because tip and t1*i* satisfy the relation of t1P>t1*i*, melt can more smoothly flow around a first outer circumference forming surface 531 which forms the first circumferential outer surface 31 of the outer ring part 3. In the same manner, in the case of a second casting cavity 54, because t2P and t2*i* satisfy the relation of t2P>t2*i*, melt can more smoothly flow around a second outer circumference forming surface 541 which forms the second circumferential outer surface 41 of the inner ring part 4. Therefore, with respect to the circumferential direction around the first outer circumference forming surface 531 and around the second outer circumference forming surface 541, a temperature variation of melt can be reduced, and a variation of solidification speed can be restrained, so that a variation in the size of graphite can be reduced.

According to this embodiment, because melt can more smoothly flow around the first outer circumference forming surface 531 of the first casting cavity 53 and around the second outer circumference forming surface 541 of the second casting cavity 54, thermal energy of melt can be increased around the corresponding portions. Therefore, in the first circumferential outer surface 31 of the outer ring part 3 and the second circumferential outer surface 41 of the inner ring part 4, the growth in the length of graphite can be promoted. As a result, the solid lubricating ability and vibration attenuation resulting from the graphite can be increased. Thereby, the reliability of the disk rotor 1 can be further enhanced.

Ninth Embodiment

Figure 8:
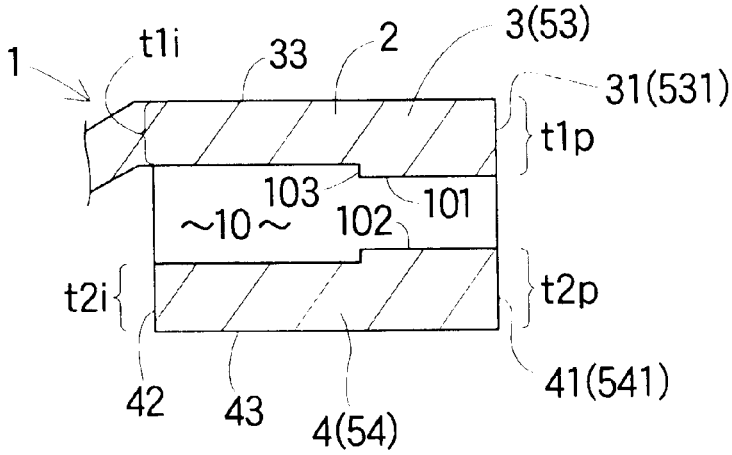
FIG. 8 is a sectional view showing portion of a circumference of a disk rotor, according to a ninth embodiment of the present invention.

FIG. 8 illustrates the ninth embodiment of the present invention. The general construction and operation of the ninth embodiment remain the same as those of the first embodiment. Hereinafter, the ninth embodiment will be explained in detail, focusing on the differences between it and the first embodiment. As shown in FIG. 8, with regard to a thickness of a sliding ring part 2, the thickness of the circumferential outer surface of the sliding ring part 2 is greater than that of the circumferential inner surface thereof. In other words, a thickness tip of a first circumferential outer surface 31 of an outer ring part 3 is greater than a thickness t1*i* of a first circumferential inner surface of the outer ring part 3 (t1P>t1*i*). Furthermore, a thickness t2P of a second circumferential outer surface 41 of an inner ring part 4 is greater than a thickness t2*i* of a second circumferential inner surface 42 of the inner ring part 4 (t2P>t2*i*). A cooling passage 10 is defined by inner walls 101 and 102 which have stepped portions 103 such that the cooling passage 10 is reduced in width to the outer side with respect to the radial direction.

Tenth Embodiment

Figure 9:
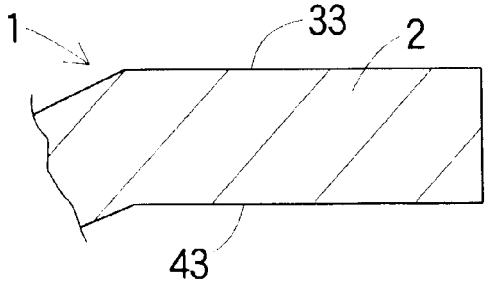
FIG. 9 is a sectional view showing portion of a circumference of a disk rotor, according to a tenth embodiment of the present invention.

FIG. 9 illustrates the tenth embodiment of the present invention. The general construction and operation of the tenth embodiment remain the same as those of the first embodiment. Hereinafter, the tenth embodiment will be explained in detail, focusing on the differences between it and the first embodiment. As shown in FIG. 9, a sliding ring part 2 has a solid structure without having a cooling passage.

Eleventh Embodiment

Figure 10:
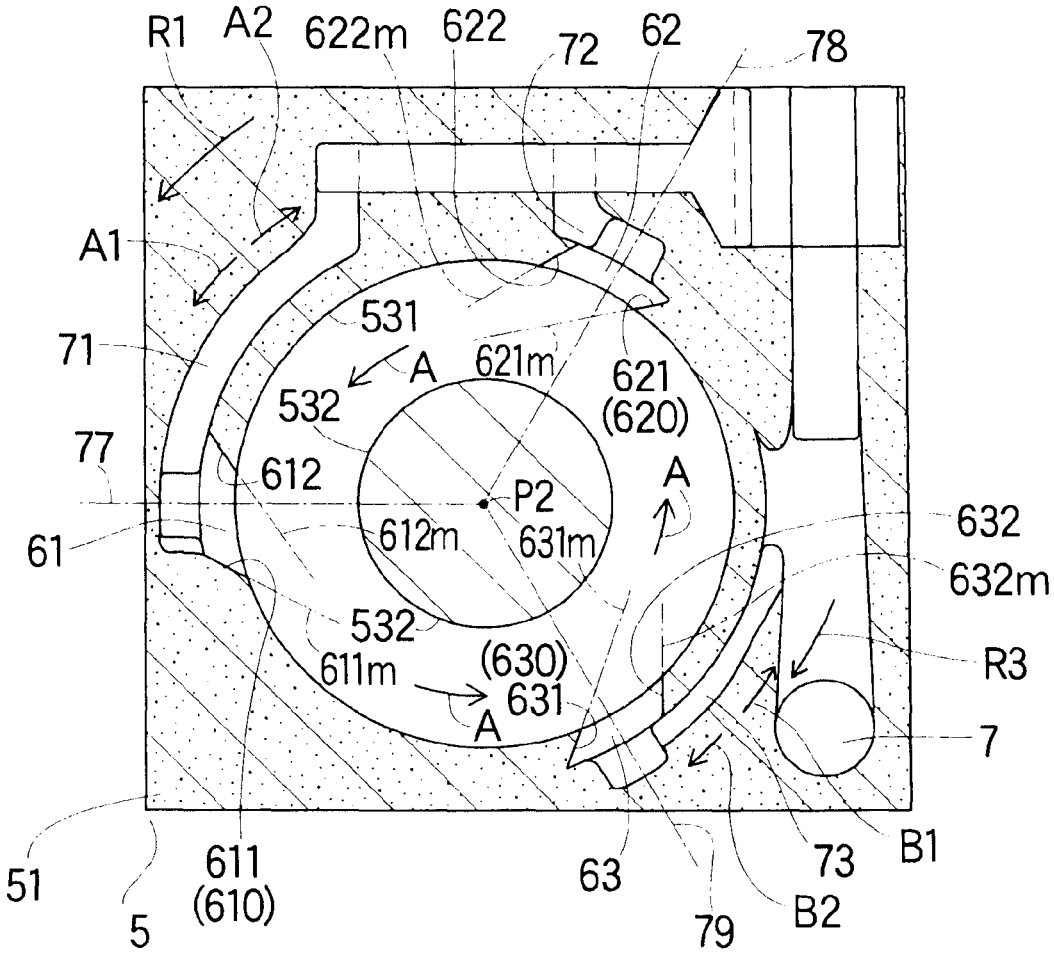
FIG. 10 is a horizontal sectional view showing a first casting cavity of a mold for casting a disk rotor, according to an eleventh embodiment of the present invention.

FIG. 10 illustrates the eleventh embodiment of the present invention. The general construction and operation of the eleventh embodiment remain the same as those of the first embodiment. Hereinafter, the eleventh embodiment will be explained in detail, focusing on the differences between it and the first embodiment. As shown in FIG. 10, first facing sidewalls 610 define a first gate 61. The first facing sidewalls 610 comprise a downstream facing sidewall 611 and an upstream facing sidewall 612 which face each other. The upstream facing sidewall 612 is disposed at an upstream side more than a first normal line 77 of the first gate 61 with respect to the direction in which melt flows, that is, with respect to the direction of the arrow A. The downstream facing sidewall 611 is disposed at a side which is downstream of the first normal line 77 of the first gate 61 with respect to the direction of the arrow A. Here, this embodiment is set such that an inclination angle of the upstream facing sidewall 612 is greater than that of the downstream facing sidewall 611 and the upstream facing sidewall 612 is thus oriented in a direction similar to a tangential direction of a first outer circumference forming surface 531. Hence, the upstream facing sidewall 612 is oriented such that an extension line 612*m* therefrom does not meet a first inner circumference forming surface 532 of a mold 5. Of course, an extension line 611*m* from the downstream facing sidewall 611 also does not meet the first inner circumference forming surface 532 of the mold 5.

Second facing sidewalls 620 which define a second gate 62 comprise an upstream facing sidewall 621 and a downstream facing sidewall 622 which face each other. The upstream facing sidewall 621 is disposed at a side which is upstream of a second normal line 78 of the second gate 62 with respect to the direction in which melt flows, that is, with respect to the direction of the arrow A. The downstream facing sidewall 622 is disposed at a side which is downstream of the second normal line 78 of the second gate 62 with respect to the direction of the arrow A. Here, this embodiment is set such that an inclination angle of the upstream facing sidewall 621 is greater than that of the downstream facing sidewall 622 and the upstream facing sidewall 621 is thus oriented in a direction similar to the tangential direction of the first outer circumference forming surface 531. Hence, the upstream facing sidewall 621 is oriented such that an extension line 621*m* therefrom does not meet the first inner circumference forming surface 532 of the mold 5. Of course, an extension line 622*m* from the downstream facing sidewall 622 also does not meet the first inner circumference forming surface 532 of the mold 5.

Third facing sidewalls 630 which define a third gate 63 comprise an upstream facing sidewall 631 and a downstream facing sidewall 632 which face each other. The upstream facing sidewall 631 is disposed at a side which is upstream of a third normal line 79 of the third gate 63 with respect to the direction in which melt flows, that is, with respect to the direction of the arrow A. The downstream facing sidewall 632 is disposed at a side downstream of the third normal line 79 of the third gate 63 with respect to the direction of the arrow A. Here, this embodiment is set such that an inclination angle of the upstream facing sidewall 631 is greater than that of the downstream facing sidewall 632 and the upstream facing sidewall 631 is thus oriented in a direction similar to the tangential direction of the first outer circumference forming surface 531. Hence, the upstream facing sidewall 631 is oriented such that an extension line 631*m* therefrom does not meet the first inner circumference forming surface 532 of the mold 5. Of course, an extension line 632*m* from the downstream facing sidewall 632 also does not meet the first inner circumference forming surface 532 of the mold 5.

According to this embodiment having the above-mentioned structure, because melt can more smoothly flow along the tangential direction, a probability of the melt coming into direct contact with the first inner circumference forming surface 532 in the radial direction is further reduced. Therefore, this embodiment makes it more easy for melt to flow in the circumferential direction along the first outer circumference forming surface 531 of the first casting cavity 53. Therefore, low-temperature melt can reliably be prevented from partially stagnating in the first casting cavity 53 with respect to the circumferential direction of the first outer circumference forming surface 531. Furthermore, it is also preferable that acute portions of the gates be formed on a forming surface of a shell core mold.

Twelfth Embodiment

To compare the first embodiment to the conventional art, the disk rotor 1 was actually formed by molding. With regard to an outer ring part 3 of the disk rotor 1, an outer diameter was 305 mm, and an average thickness was 9 mm. In the case of an inner ring part 4, an outer diameter was 305 mm, an inner diameter was 168 mm, and an average thickness was 9 mm. The composition of melt was equivalent to FC150 and had a mass ratio of C:3.55%, Si:2.15%, Mn:0.58%, P:0.035%, S:0.090%, and a remnant including Fe and unavoidable impurities.

With regard to this disk rotor 1, a difference (variation) in average length of graphite with respect to the circumferential direction was obtained. Here, a micrograph was image-processed using an image processor, and a variation in average length of graphite is processed by software. An image processor for cast iron structure analysis ("OTG-502 campus" made by Osaka special alloy company LTD.) was used as the image processor. Furthermore, a linear distance between both ends of flake graphite was measured as the length of graphite. Between the conventional art and the first embodiment, the size and thickness of the disk rotor, the composition of melt, the material of the mold 5, the composition of cast iron and conditions of molding were the same. Only, the mold of the conventional art is set as $\theta 1=\theta 2=\theta 3=0°$, and the mold of the first embodiment is set as $\theta 1=\theta 2=\theta 3=60°$.

Figure 11:
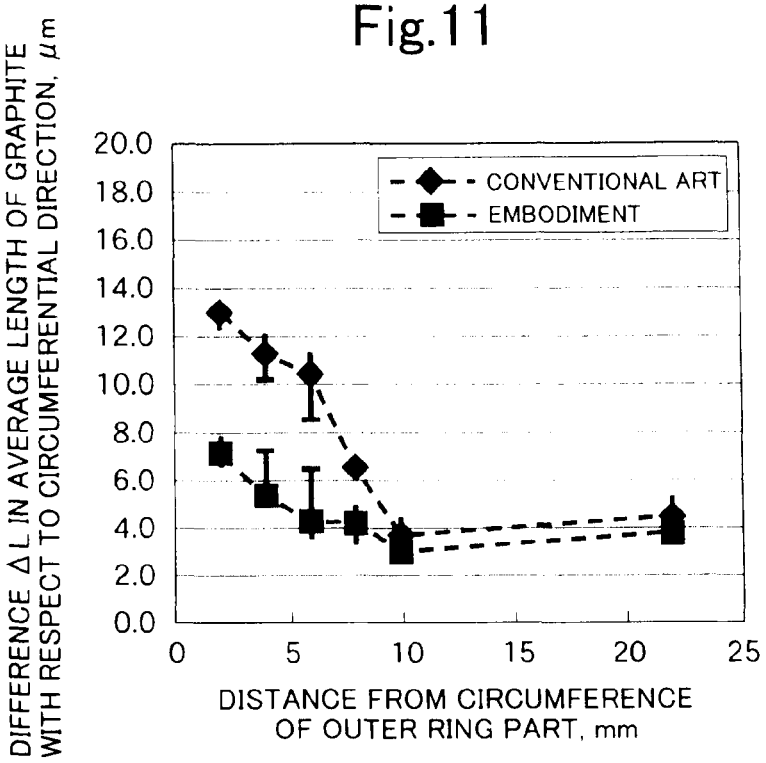
FIG. 11 is a graph showing results of a test on an outer ring part of the disk rotor.
Figure 12:
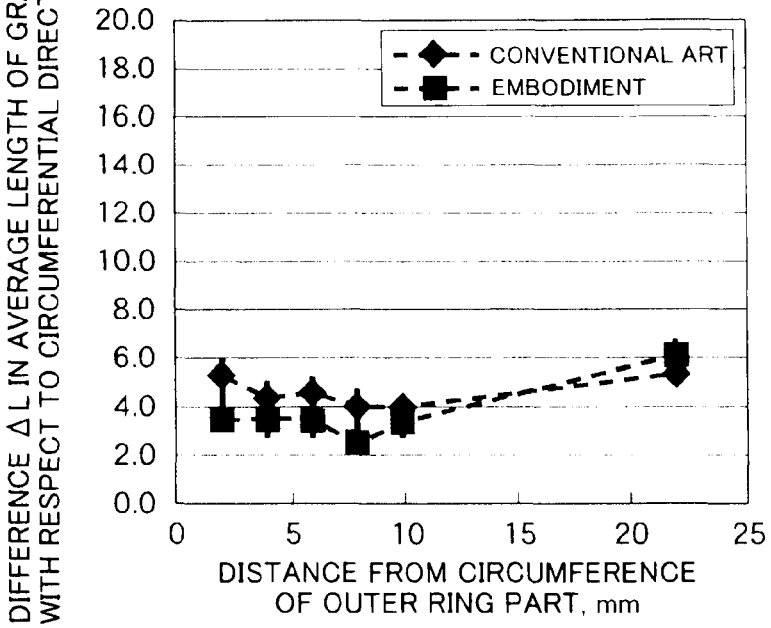
FIG. 12 is a graph showing results of a test on an inner ring part of the disk rotor.

FIG. 11 shows a result (n=10) of a test on the outer ring part 3 of the disk rotor 1. FIG. 12 shows a result (n=10) of a test on the inner ring part 4 of the disk rotor 1. In the graph of FIG. 11, the abscissa denotes a distance spaced apart from the first circumferential outer surface 31 of the outer ring part 3 towards the first circumferential inner surface in the radial direction. In addition, the ordinate denotes a difference ΔL in average length of graphite with respect to the circumferential direction. In the graph of FIG. 12, the abscissa denotes a distance spaced apart from the second circumferential outer surface 41 of the inner ring part 4 towards the second circumferential inner surface 42 in the radial direction. The ordinate denotes a difference ΔL in average length of graphite with respect to the circumferential direction.

In FIGS. 11 and 12, the mark ♦ (black rhombus) shows a difference ΔL (variation) in length of graphite in the case of the mold of the conventional art. The mark ■ (black square) shows a difference ΔL (variation) in length of graphite in the case of the mold of the first embodiment. As shown in FIG. 11, with regard to the outer ring part 3 of the disk rotor 1, in the case of the conventional art, the difference ΔL around the first circumferential outer surface 31 was relatively large. However, in the case of the first embodiment, the difference ΔL around the first circumferential outer surface 31 was reduced. Furthermore, as shown in FIG. 12, with regard to the inner ring part 4 of the disk rotor 1, in the case of the first embodiment, the difference ΔL around the second circumferential outer surface 41 was reduced, compared to the case of the conventional art.

As shown in FIG. 11, with regard to the outer ring part 3 pertaining to the side at which the gate group 6 is formed, the difference ΔL in the first embodiment was markedly reduced compared to that of the conventional art. That is, it can be appreciated that the first embodiment is superior. With regard to the inner ring part 4 pertaining to the side at which the gate group 6 is not formed, the difference ΔL in the first embodiment was reduced compared to that of the conventional art, but a reduction of the difference ΔL is not marked. In FIG. 1, the numerals [2, 4, 6, 8, 10, 22] which are marked on the first circumferential outer surface and the second circumferential outer surface 41 of the disk rotor 1 denote a distance (mm) spaced apart from the first circumferential outer surface 31 and the second circumferential outer surface 41 inwards in the radial direction.

Figure 13:
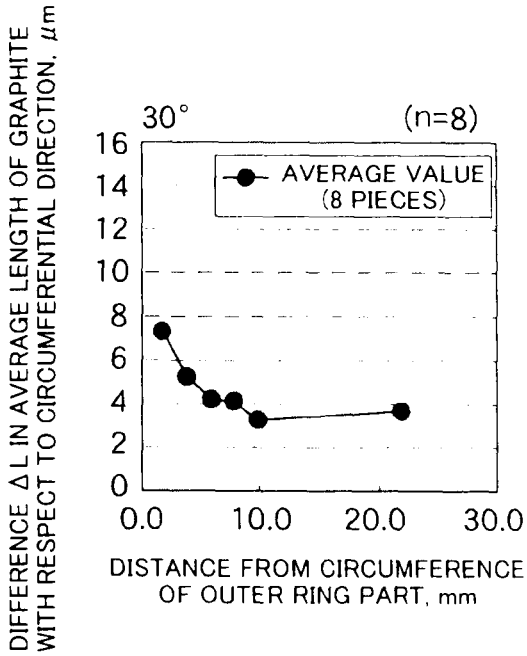
FIG. 13 is a graph showing results of a test on a disk rotor manufactured by casting under conditions in which each of θ1, θ2 and θ3 is 30°.
Figure 14:
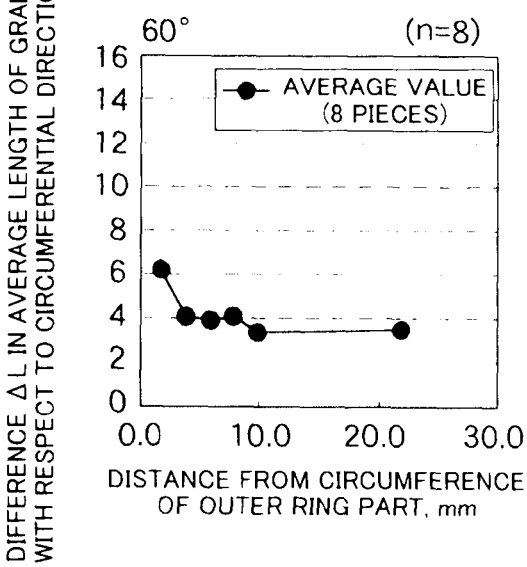
FIG. 14 is a graph showing results of a test on a disk rotor manufactured by casting conditions in which each of θ1, θ2 and θ3 is 60° according to the present invention.
Figure 15:
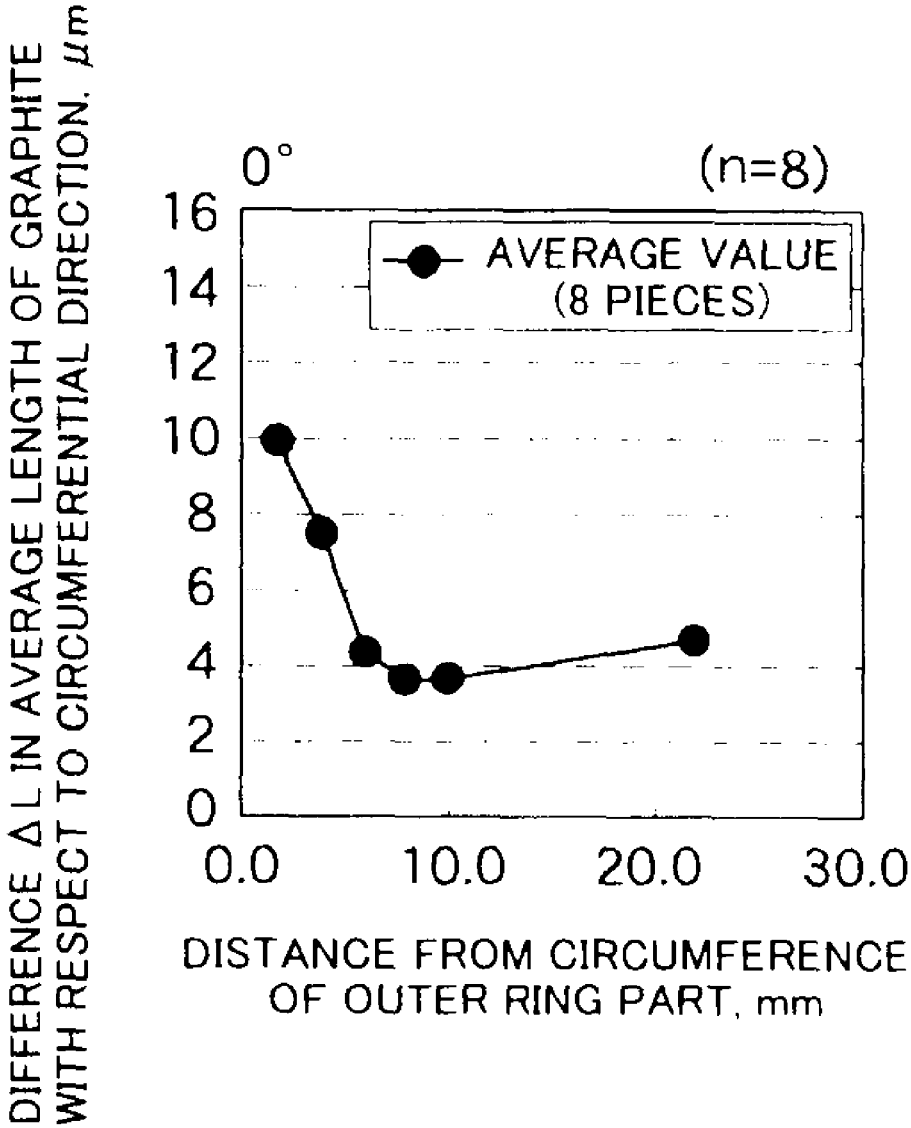
FIG. 15 is a graph showing results of a test on a disk rotor manufactured by casting conditions in which each of θ1, θ2 and θ3 is 0° according to the conventional art.
Figure 16:
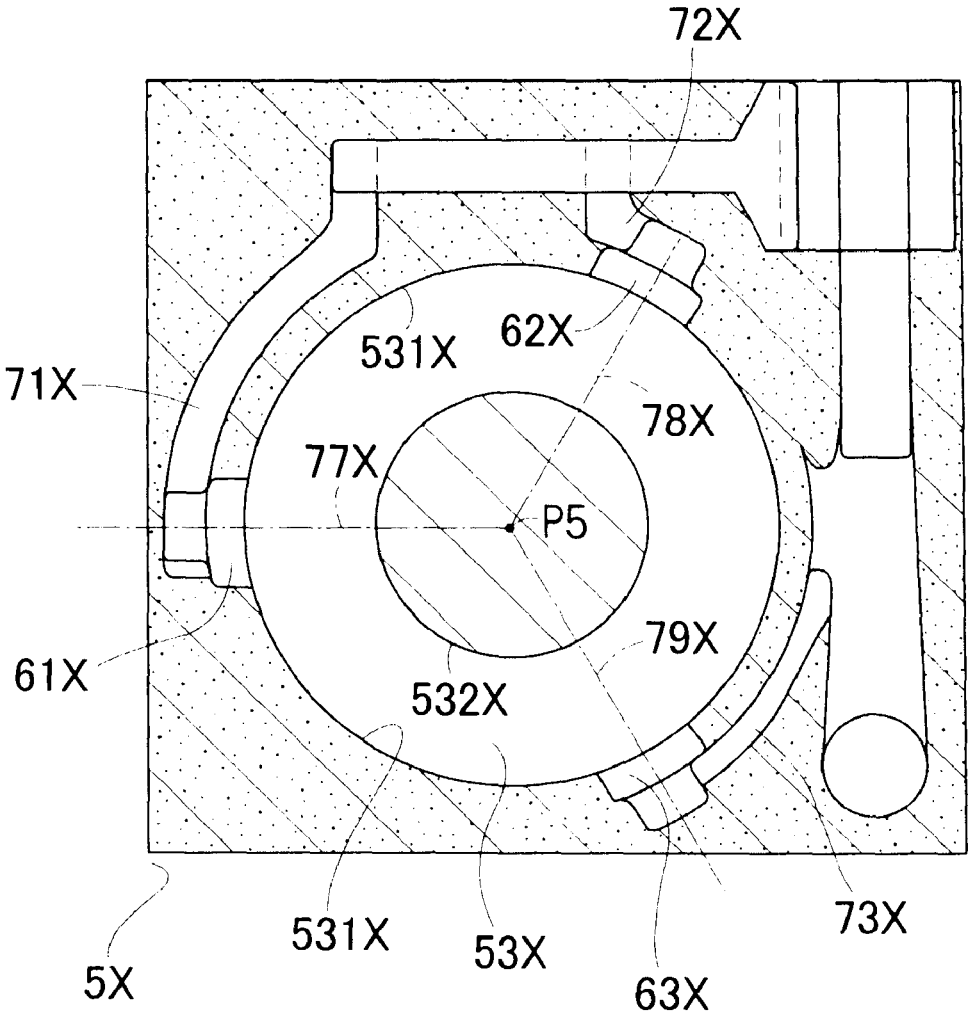
Fig.16 (CONVENTIONAL ART)
FIG. 16 is a horizontal sectional view showing a first casting cavity of a mold for casting a disk rotor, according to the conventional art.

In addition, disk rotors 1 were formed by casting under the same conditions to test effects depending on variation of θ1, θ2 and θ3. FIGS. 13 through 15 show the results (n=8) of the tests on the outer ring part 3 of the disk rotor 1. FIG. 13 shows the results (n=8) of the test in the case where θ1, θ2 and θ3 satisfy $\theta 1=\theta 2=\theta 3=30°$. FIG. 14 shows the results (n=8) of the test in the case where θ1, θ2 and θ3 satisfy $\theta 1=\theta 2=\theta 3=60°$. FIG. 15 shows the results of the test on the case of the conventional art in which θ1, θ2 and θ3 satisfy $\theta 1=\theta 2=\theta 3=0°$. The ordinate and abscissa are as stated above.

As shown in FIG. 15, in the case of $\theta 1=\theta 2=\theta 3=0°$, a difference ΔL was relatively large. Particularly, a difference ΔL around the circumference of the sliding ring part was markedly increased. As shown in FIGS. 13 and 14, in the case of $\theta 1=\theta 2=\theta 3=30°$ or $\theta 1=\theta 2=\theta 3=60°$, a difference ΔL was relatively small, compared to the case of the conventional art. Particularly, in the case of $\theta 1=\theta 2=\theta 3=60°$, a difference ΔL is further reduced, compared to the case of $\theta 1=\theta 2=\theta 3=30°$. The reason for this is as follows. As the inclination angles of the gates 61, 62 and with respect to the normal lines are increased, the direction in which melt is injected into the first casting cavity 53 becomes parallel to the tangential direction. Therefore, a temperature variation of melt with respect to the circumferential direction around the first outer circumference forming surface 531 of the first casting cavity 53 can be reduced. In addition, a temperature variation of melt with respect to the circumferential direction around the second outer circumference forming surface 541 of the second casting cavity 54 can also be reduced. As well, a partial variation of the solidification speed of melt with respect to the circumferential direction can be restrained. As a result, a variation in the size of graphite with respect to the circumferential direction can be reduced.

[Modification]

In the first embodiment, although the first gate 61, the second gate 62 and the third gate 63 have been illustrated as being formed in the first outer circumference forming surface 531 of the first casting cavity 53 (the cavity that forms the outer ring part 3), the present invention is not limited to this. For example, the first gate 61, the second gate 62 and the third gate 63 may be formed in the second outer circumference forming surface 541 of the second casting cavity 54 which forms the inner ring part 4 at positions spaced apart from each other at regular intervals with respect to the circumferential direction. Furthermore, θ1, θ2 and θ3 may be set such that they satisfy $90°>\theta 2>\theta 3>\theta 1>0°$, $90°>\theta 2>\theta 3>\theta 1>10°$, $90°>\theta 1>\theta 3>\theta 2>0°$ or $90°>\theta 1>\theta 3>\theta 2>10°$. While the invention has been shown and described with respect to the preferred embodiments, it will be understood by those skilled in the art that various changes and modification may be made without departing from the spirit and scope of the invention as defined in the following claims.

From the above description, the following technique can be understood.

[Addition 1] A method for casting a cast iron rotary body made of cast iron including graphite, the rotary body including a sliding ring part having a circumferential outer surface and a circumferential inner surface, with a sliding surface formed between the circumferential outer surface and the circumferential inner surface of the sliding ring part, the method comprising: preparing a mold, comprising: a casting cavity to cast the sliding ring part, the casting cavity having an annular shape; an outer circumference forming surface to form the circumferential outer surface of the sliding ring part; an inner circumference forming surface to form the circumferential inner surface of the sliding ring part; a gate group including a plurality of gates formed in the outer circumference forming surface at positions spaced apart from each other at predetermined intervals with respect to a circumferential direction, each of the gates having a central line inclined at an angle greater than 0° and less than 90° with respect to a normal line passing through a center of the casting cavity in a radial direction; runners respectively communicating with the gates constituting the gate group; and a sprue communicating with the runners; and pouring melt into the sprue of the mold, and supplying the melt to the gates of the gate group through the runners, and injecting the melt from the gates into the casting cavity at angles greater than 0° and less than 90° with respect to the normal lines, and solidifying the melt. A brake drum, a fly wheel, etc., are representative examples of a cast iron rotary body.

[Addition 2] The method for casting the cast iron rotary body according to addition 1, wherein, the central lines of the gates constituting the gate group are inclined in one same direction with respect to the circumferential direction around the center of the casting cavity.

INDUSTRIAL APPLICABILITY

The present invention provides a method for casting a disk rotor which is used in a brake system for vehicles or industrial equipment.

The invention claimed is:

1. A method for casting a disk rotor made of cast iron including graphite, the disk rotor including a sliding ring part having a circumferential outer surface and a circumferential inner surface, with a sliding surface formed between the circumferential outer surface and the circumferential inner surface of the sliding ring part, the method comprising:

preparing a mold, including:

a casting cavity to cast the sliding ring part, the casting cavity having an annular shape;

an outer circumference forming surface to form the circumferential outer surface of the sliding ring part;

an inner circumference forming surface to form the circumferential inner surface of the sliding ring part;

a gate group including a plurality of gates formed in the outer circumference forming surface at positions spaced apart from each other at predetermined intervals with respect to a circumferential direction, each of the gates having a central line in a plane of a horizontal cross section of the mold, the central line extending in a horizontal injection direction of melt into the casting cavity and being inclined at an angle greater than 0° and less than 90° with respect to a corresponding normal line in the plane passing through a center of the casting cavity in a radial direction;

runners respectively communicating with the gates constituting the gate group;

and a sprue communicating with the runners, the gates constituting the gate group including a distal gate that includes a longest flow distance of melt flowing from the sprue and a proximal gate that includes a shortest flow distance of melt flowing from the sprue, an inertial direction of melt flowing to the distal gate through a corresponding one of the runners is designated as a normal flow direction for the distal gate, the distal gate is inclined in a direction such that melt injected from the distal gate into the casting cavity flows in the normal flow direction for the distal gate, and the proximal gate is inclined in a direction corresponding to a flowing direction of melt injected from the proximal gate into the casting cavity;

pouring melt into the sprue of the mold;

supplying the melt to the gates of the gate group through the runners;

injecting the melt from the gates in the horizontal injection direction into the casting cavity at angles greater than 0° and less than 90° with respect to the corresponding normal lines; and solidifying the melt.

2. The method according to claim 1, wherein the preparing the mold includes, of the gates constituting the gate group besides the distal gate and the proximal gate, a remaining gate of the gate group that is inclined in a direction corresponding to the flowing direction of melt injected from the distal gate into the casting cavity.

3. The method according to claim 1, wherein the preparing the mold includes the runners including a runner for the distal gate communicating with the distal gate and the runner for the proximal gate communicating with the proximal gate, a flowing direction of melt in the runner for the distal gate is reverse from a flowing direction of melt in the runner for the proximal gate, an inertial direction of melt flowing to the proximal gate through the runner for the proximal gate is designated as a normal flow direction for the proximal gate, a direction opposite the normal flow direction for the proximal gate is designated as a reverse flow direction for the proximal gate, and the proximal gate is inclined in a direction such that melt injected from the proximal gate into the casting cavity flows in a direction corresponding to the reverse flow direction for the proximal gate.

4. The method according to claim 1, wherein the preparing the mold includes, of the gates constituting the gate group, the distal gate being inclined at a largest angle with respect to the corresponding normal line.

5. The method according to claim 1, wherein the preparing the mold includes, of the gates constituting the gate group, the proximal gate being inclined at a largest angle with respect to the corresponding normal line.

6. The method according to claim 1, wherein the preparing the mold includes the mold including a mold body and a shell core mold supported by the mold body, the shell core mold being hardened using a binder, wherein at least a portion of a gate space of the gate group is partitioned by a shell forming surface of the shell core mold.

7. The method according to claim 1, wherein the preparing the mold includes, with regard to a thickness of the sliding ring part, the circumferential outer surface of the sliding ring part being greater than the circumferential inner surface of the sliding ring part.

8. The method according to claim 1, wherein the preparing the mold includes each of the gates being defined by two facing sidewalls facing each other, wherein at least one of extension lines extending from the two facing sidewalls is prevented from being in contact with the inner circumference forming surface of the mold.

9. The method according to claim 1, wherein the preparing the mold includes the central lines of the gates constituting the gate group being inclined in one same direction with respect to the circumferential direction around the center of the casting cavity.

10. The method according to claim 1, wherein the preparing the mold includes the central line of each gate being inclined at an angle from 10° to 85° with respect to the corresponding normal line, and wherein the injecting the melt includes injecting the melt from the gates into the casting cavity at angles from 10° to 85° with respect to the corresponding normal lines.

11. The method according to claim 1, wherein the preparing the mold includes the central line of each gate being inclined at an angle from 20° to 70° with respect to the corresponding normal line, and wherein the injecting the melt includes injecting the melt from the gates into the casting cavity at angles from 20° to 70° with respect to the corresponding normal lines.

12. The method according to claim 1, wherein the preparing the mold includes the central line of each gate being inclined at an angle from 30° to 60° with respect to the corresponding normal line, and wherein the injecting the melt includes injecting the melt from the gates into the casting cavity at angles from 30° to 60° with respect to the corresponding normal lines.

* * * * *